US012502615B1

(12) United States Patent
Chan et al.

(10) Patent No.: US 12,502,615 B1
(45) Date of Patent: Dec. 23, 2025

(54) TOY FIGURINE WITH EXTENDABLE SURPRISE ELEMENTS

(71) Applicant: Mattel, Inc., El Segundo, CA (US)

(72) Inventors: Patricia Chan, Redondo Beach, CA (US); Steven D. Ryniker, Torrance, CA (US); Andrew Sik lun Wong, Torrance, CA (US); James Molina, Westminster, CA (US)

(73) Assignee: MATTEL, INC., El Segundo, CA (US)

( * ) Notice: Subject to any disclaimer, the term of this patent is extended or adjusted under 35 U.S.C. 154(b) by 0 days.

(21) Appl. No.: 19/071,831

(22) Filed: Mar. 6, 2025

(51) Int. Cl.
*A63H 3/20* (2006.01)
*A63H 3/48* (2006.01)
*A63H 3/52* (2022.01)

(52) U.S. Cl.
CPC ..... *A63H 3/20* (2013.01); *A63H 3/48* (2013.01); *A63H 3/52* (2013.01)

(58) Field of Classification Search
CPC ... A63H 3/20; A63H 3/44; A63H 3/48; A63H 3/52; A63H 13/00
USPC ..... 446/330, 352
See application file for complete search history.

(56) References Cited

U.S. PATENT DOCUMENTS 549,039 A * 10/1895 Wenger ..... G09F 19/08 40/411
1,679,847 A 8/1928 Webb
1,778,670 A 10/1930 Herbison
2,380,175 A 7/1945 Hawkey
3,471,964 A 10/1969 Cherry et al.
3,597,877 A 8/1971 Speers
4,738,881 A * 4/1988 Lee ..... A41G 1/002 428/12
4,795,398 A 1/1989 Wexler
5,149,289 A 9/1992 Edwards et al.
5,194,030 A 3/1993 LeBoeuf et al.
5,299,968 A 4/1994 Bennett
5,522,758 A 6/1996 Liu et al.
5,624,320 A 4/1997 Martinez
5,713,778 A * 2/1998 Radosevich ..... A63H 3/24 446/296
5,868,598 A 2/1999 Dinovo
6,132,285 A * 10/2000 Feldman ..... A63H 3/20 446/268
7,384,325 B2 * 6/2008 Kelly ..... A63H 3/36 446/268
7,842,359 B2 11/2010 Marlow
8,133,090 B2 3/2012 Hardin
8,506,344 B2 8/2013 Chan et al.
(Continued)

FOREIGN PATENT DOCUMENTS

CA 2193463 A1 6/1997
CA 2273375 A1 11/2000
(Continued)

*Primary Examiner* — Joseph B Baldori
(74) *Attorney, Agent, or Firm* — Edell, Shapiro & Finnan, LLC

(57) ABSTRACT

A toy figurine and/or toy includes a body portion having one or more openings and styling features, the one or more openings being at least partially obscured by the styling features, and a mechanism with an actuator configured to extend externally of the body portion, wherein actuating the actuator from a first position to a second position causes surprise elements to move out of the one or more openings to change a styling of the body portion.

20 Claims, 20 Drawing Sheets

(56) References Cited

U.S. PATENT DOCUMENTS

| | | | | |
|---|---|---|---|---|
| 8,597,070 | B2 * | 12/2013 | Chang | G09F 19/08 446/175 |
| 8,932,100 | B2 * | 1/2015 | Saunders | A63H 13/04 446/330 |
| 9,061,219 | B2 | 6/2015 | Fiore | |
| 9,101,846 | B2 * | 8/2015 | Chan | A63H 3/00 |
| 9,168,462 | B2 * | 10/2015 | Jung | A63H 3/48 |
| 9,359,125 | B2 | 6/2016 | Pavlu, Jr. | |
| 9,586,153 | B2 * | 3/2017 | Saunders | A63H 3/20 |
| 9,636,597 | B2 | 5/2017 | Rehkemper et al. | |
| 9,878,261 | B1 * | 1/2018 | Fung | A63H 33/26 |
| 10,786,745 | B2 | 9/2020 | Chan et al. | |
| 10,981,075 | B2 * | 4/2021 | Bellon | A63H 3/20 |
| 11,235,253 | B2 * | 2/2022 | Towne | A63H 3/36 |
| 2012/0052764 | A1 * | 3/2012 | Chan | A63H 33/003 446/321 |
| 2014/0329434 | A1 * | 11/2014 | Saunders | A63H 3/20 446/330 |
| 2016/0121233 | A1 | 5/2016 | Yang | |
| 2017/0348603 | A1 | 12/2017 | Johnson et al. | |
| 2018/0229133 | A1 * | 8/2018 | Law | A63H 3/20 |
| 2021/0170295 | A1 | 6/2021 | Wallace | |

FOREIGN PATENT DOCUMENTS

| | | | |
|---|---|---|---|
| WO | 2012096660 | A1 | 7/2012 |
| WO | 2021186903 | A1 | 9/2021 |
| WO | 2022070738 | A1 | 4/2022 |

* cited by examiner

TOY FIGURINE WITH EXTENDABLE SURPRISE ELEMENTS

FIELD OF THE INVENTION

The present application relates generally to toys and, in particular, to toys such as dolls or figurines that can be toggled to either show or hide surprise elements.

BACKGROUND

Through the years, toy dolls and figurines (for simplicity, referred to herein as toy figurines) have provided amusement and entertainment for children of all ages. To increase the inherent play value of these toy figurines, various features, such as different actions, movements, or other functions, have been incorporated into some toy figurines (e.g., so that the toy figurine can appear to walk, crawl, talk, change shape, etc.).

Some toys and toy figurines may entertain users by providing different togglable states, such as those that can change configurations through physical interaction, and present a unique opportunity to captivate children's attention. However, designing such toys to effectively engage children can be difficult. Some of the challenges include creating an intuitive and safe interaction mechanism that encourages sustained engagement and imaginative play. Thus, there is a continuing need for more interesting and varied toy or toy figurine features. Less-engaging toys may fail to entertain a child and the child may quickly become bored with such a toy.

SUMMARY

A toy figurine and/or a toy are presented herein. In at least some embodiments, the toy figurine and/or toy includes a body portion having a slot and one or more openings, a linear actuator substantially inside of the body portion, wherein the linear actuator includes a trigger that extends through the slot, wherein sliding the trigger from a first position to a second position along the slot causes the linear actuator to linearly move one or more connector elements within the body portion, and one or more surprise elements attached to each of the one or more connector elements, wherein the one or more surprise elements are biased to unfold when the one or more connector elements and the one or more surprise elements extend through the one or more openings of the body portion while the trigger slides from the first position to the second position.

In at least some embodiments, the toy figurine and/or toy includes a body portion having one or more openings and styling features, the one or more openings being at least partially obscured by the styling features, and a mechanism with an actuator configured to extend externally of the body portion, wherein actuating the actuator from a first position to a second position causes surprise elements to move out of the one or more openings to change a styling of the body portion.

In at least some other embodiments, the toy figurine and/or toy comprises a body portion having an opening and a linear actuator enclosed within the body portion, wherein the linear actuator is moveable between a first position and a second position. The linear actuator includes a connector element and a surprise element coupled to the connector element. A flexible element inside the body portion connects the surprise element to the body portion. In the first position, the connector element and surprise element are both retracted inside the body portion and the surprise element is in a folded state. In the second position, the connector element is extended through the opening and the surprise element is in an unfolded state outside the body portion.

Other systems, methods, features and advantages will be, or will become, apparent to one with skill in the art upon examination of the following figures and detailed description. All such additional systems, methods, features and advantages are included within this description, are within the scope of the claimed subject matter.

BRIEF DESCRIPTION OF THE DRAWINGS

The toy figurine and/or toy presented herein may be better understood with reference to the following drawings and description. The elements in the figures are not necessarily to scale, emphasis instead being placed upon illustrating the principles of the toy figurine. In the figures, like-referenced numerals designate corresponding parts throughout the different views.

FIG. 2A is a front view of the toy figurine in a first togglable state.

FIG. 2B is a front view of the toy figurine in a second togglable state. FIG. 2C is a bottom perspective view of the toy figurine in the first togglable state. FIG. 2D is a rear view of the toy figurine in the first togglable state.

FIG. 10A is a side view of a surprise element partially retracted within a cavity. FIG. 10B is a side view of the connector element extended to the point the surprise element is no longer within the cavity. FIG. 10C is a side view of the connector element fully extended.

DETAILED DESCRIPTION

The toy figurine and/or the toy presented herein includes foldable surprise elements that can be extended from, and retracted into, the body of the toy figurine and/or toy. The surprise elements may comprise a soft collapsible material, such as fabric, so that the surprise elements can unfold and/or expand when extended from the body and can fold and/or collapse when retracted into the body, whereupon the surprise elements may be substantially hidden from view. The surprise elements can include any decoration or combinations thereof, and can match a theme of the toy figurine and/or toy. As an example embodiment, a toy figurine may be a merfolk (e.g., mermaid, merman, etc.), and the surprise elements may be flowers and/or sea-themed objects (e.g., aquatic flora and/or fauna). In other embodiments, the surprise elements may be butterfly wings, feathers, crystals, ribbons, stars, glowing objects, fashion accessories, and the like. The surprise elements are extended or retracted using an internal actuator system inside the toy figurine and/or toy in which one or more internal elements cause the surprise elements, which are attached to the one or more internal elements, to align with holes on the body of the toy figurine and/or toy and extend externally from the body as well as retract into the body. The internal actuator system is further configured with linkages such that the surprise elements are able to turn and face or open toward a specific direction after extending from the body of the toy figurine or toy.

Thus, present embodiments increase play value beyond the value already provided by a conventional toy figurine and/or toy by further providing togglable states for the toy figurine and/or toy. In particular, a user can selectively toggle the toy figurine and/or toy between a first state in which surprise elements are retracted and substantially out of view and a second state in which the surprise elements are extended and visible. This provides the practical application of increasing the novelty, desirability, and entertainment value of a toy figurine and/or toy.

Figure 1:
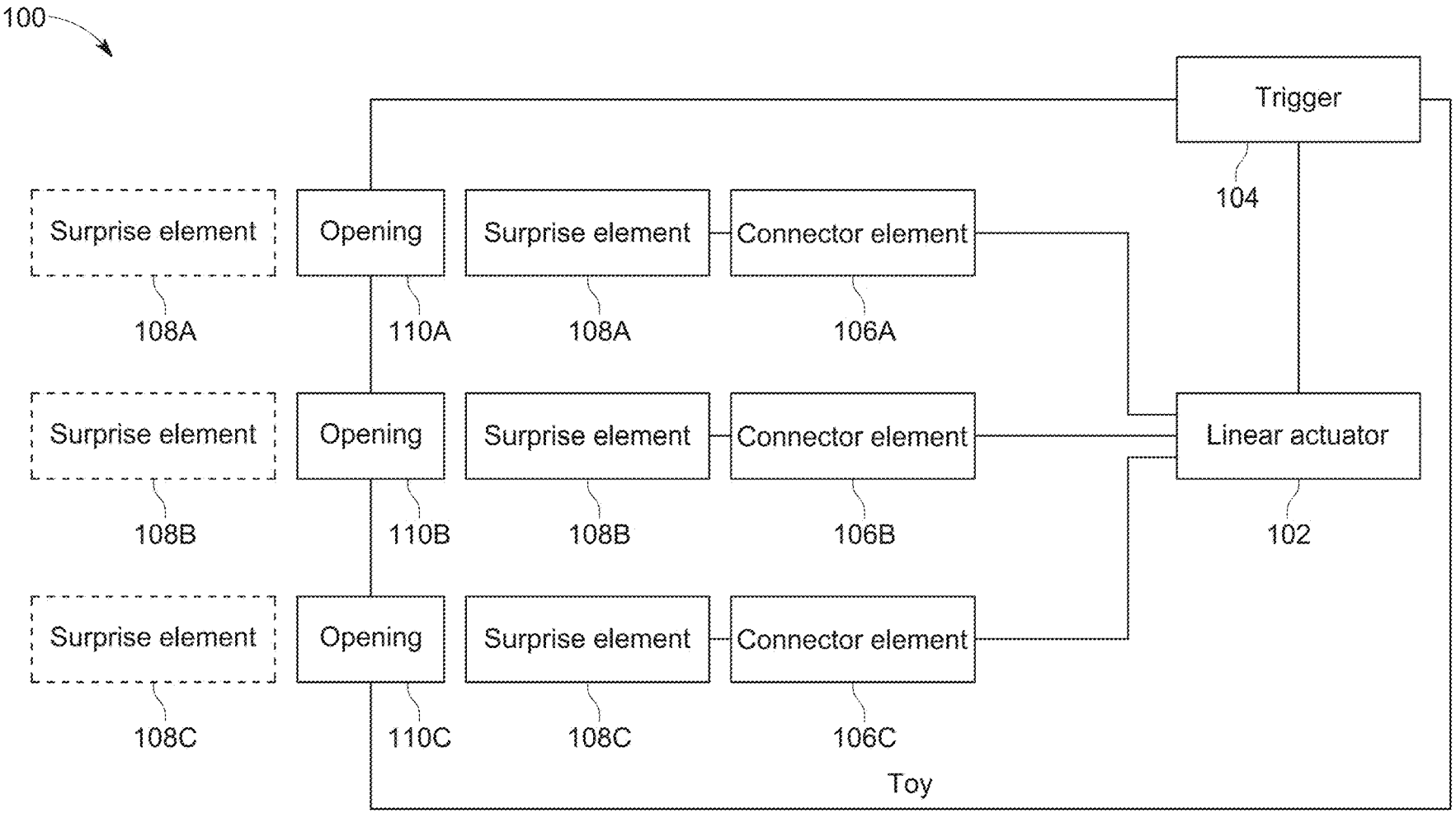
FIG. 1 is a block diagram depicting a toy with extendable surprise elements in accordance with an example embodiment.

FIG. 1 is a block diagram depicting a toy 100 with extendable surprise elements in accordance with an example embodiment. As depicted, the toy 100 includes a linear actuator 102, a trigger 104, connector elements 106A-106C, surprise elements 108A-108C, and openings 110A-110C. The trigger 104 engages with the linear actuator 102 to cause substantially linear movement of one or more elements, which can include the connector elements 106A-106C and/or surprise elements 108A-108C. In particular, the connector elements 106A-106C may be attached to, or otherwise be incorporated into, the linear actuator 102, and the surprise elements 108A-108C may be likewise attached to, or otherwise incorporated into, the connector elements 106A-106C. Thus, movement of the linear actuator 102 translates into movement of the connector elements 106A-106C and the surprise elements 108A-108C. In a first toggleable state of the toy 100 (schematically illustrated via solid boxes in FIG. 1), the surprise elements 108A-108C may reside substantially inside of the body of the toy 100. However, when the trigger 104 is actuated, the movement of the linear actuator 102 causes the toy 100 to enter into a second toggleable state in which the surprise elements 108A-108C extend through the openings 110A-110C and are visible to a user (schematically illustrated via dashed boxes in FIG. 1). The surprise elements may extend through the openings simultaneously, or in other embodiments at different time points.

In various embodiments, the linear actuator 102 may include any mechanism for creating substantially linear movement, and can include electric, electromagnetic, hydraulic, pneumatic, human-powered mechanisms, etc. The linear actuator 102 can be a rack-and-pinion mechanism, a pulley and/or belt system, a screw jack system, a ratchet mechanism, and the like. Moreover, it should be appreciated that the count of various elements of the toy 100 depicted in FIG. 1 can vary in different embodiments. For example, there may be any number of connector elements and/or surprise elements. Additionally, the number of surprise elements per connector element may vary, as a connector element can have one or more surprise elements. In some embodiments, the number of openings may match the number of surprise elements (i.e., one opening per surprise element), but in other embodiments, multiple surprise elements may extend through a single opening. Furthermore, while the rest of the description provides details of toy figurines as illustrative examples, it is understood that the features and mechanisms described herein may also be incorporated into toys of other form factors such as buildings (e.g., houses), structures (e.g., flower beds), vehicles, and other objects.

Figure 2A:
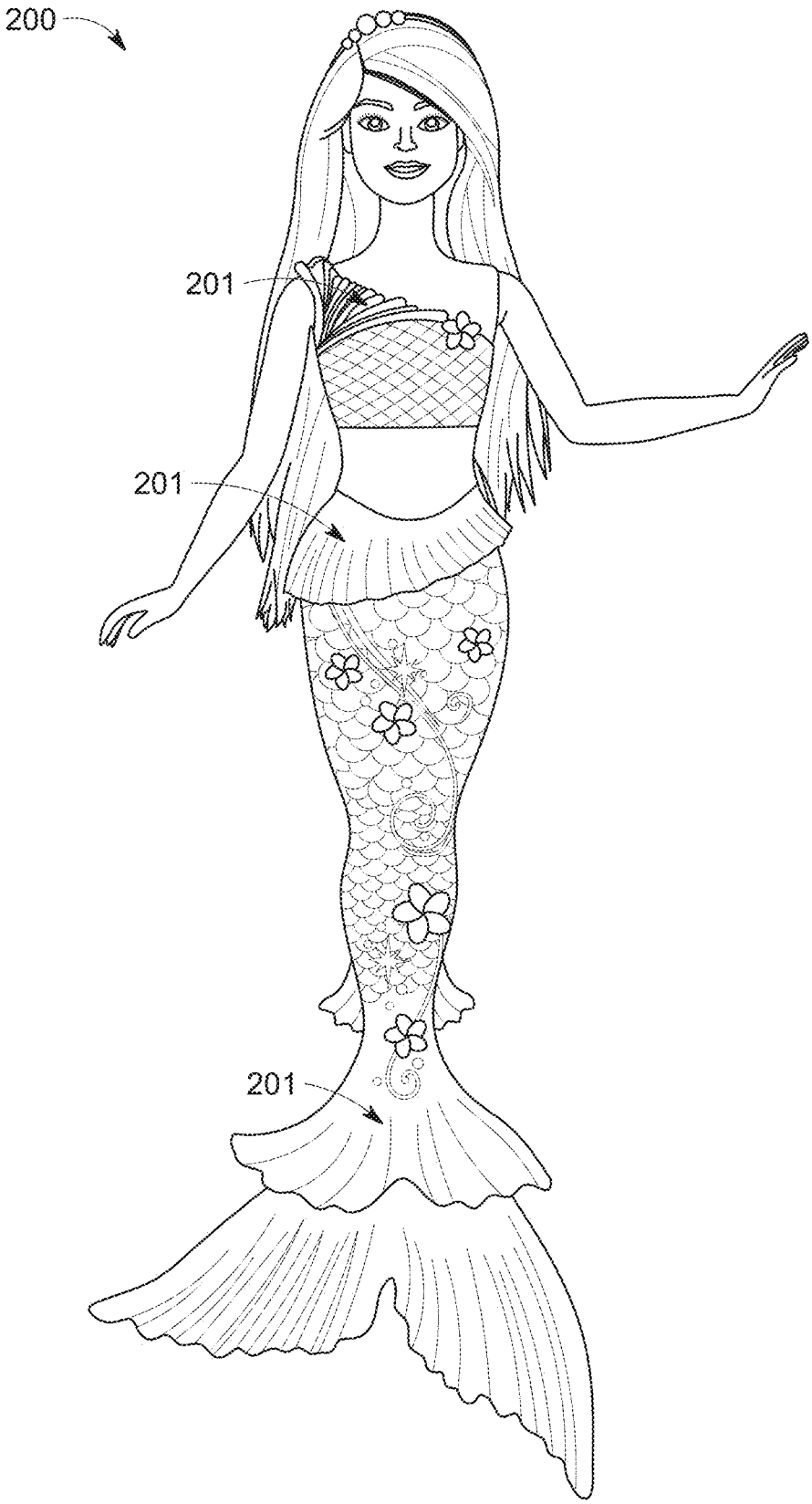
FIGS. 2A-2D illustrate various views of an example embodiment of a toy figurine with extendable surprise elements.
Figure 2B:
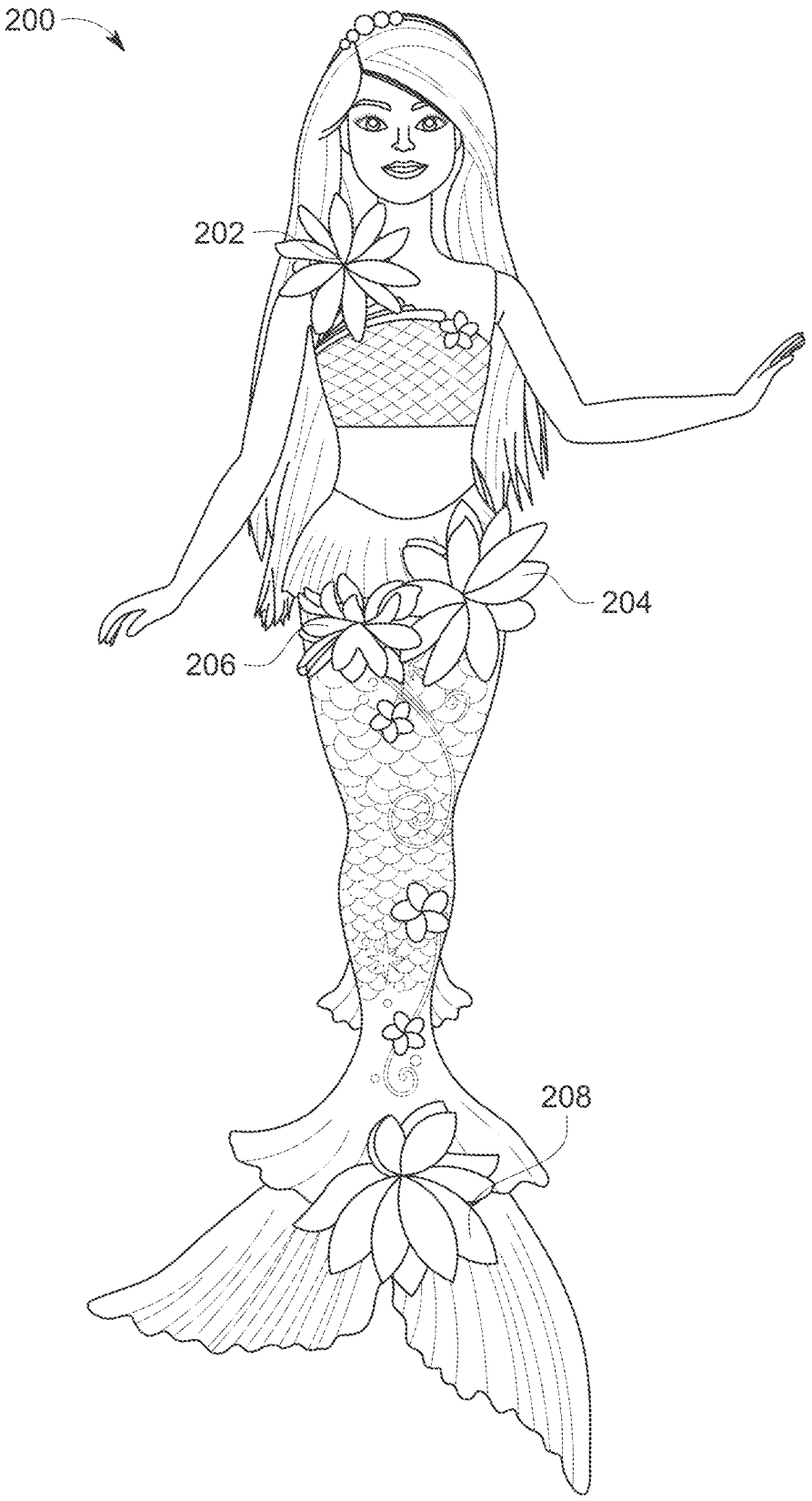
Figure 2C:
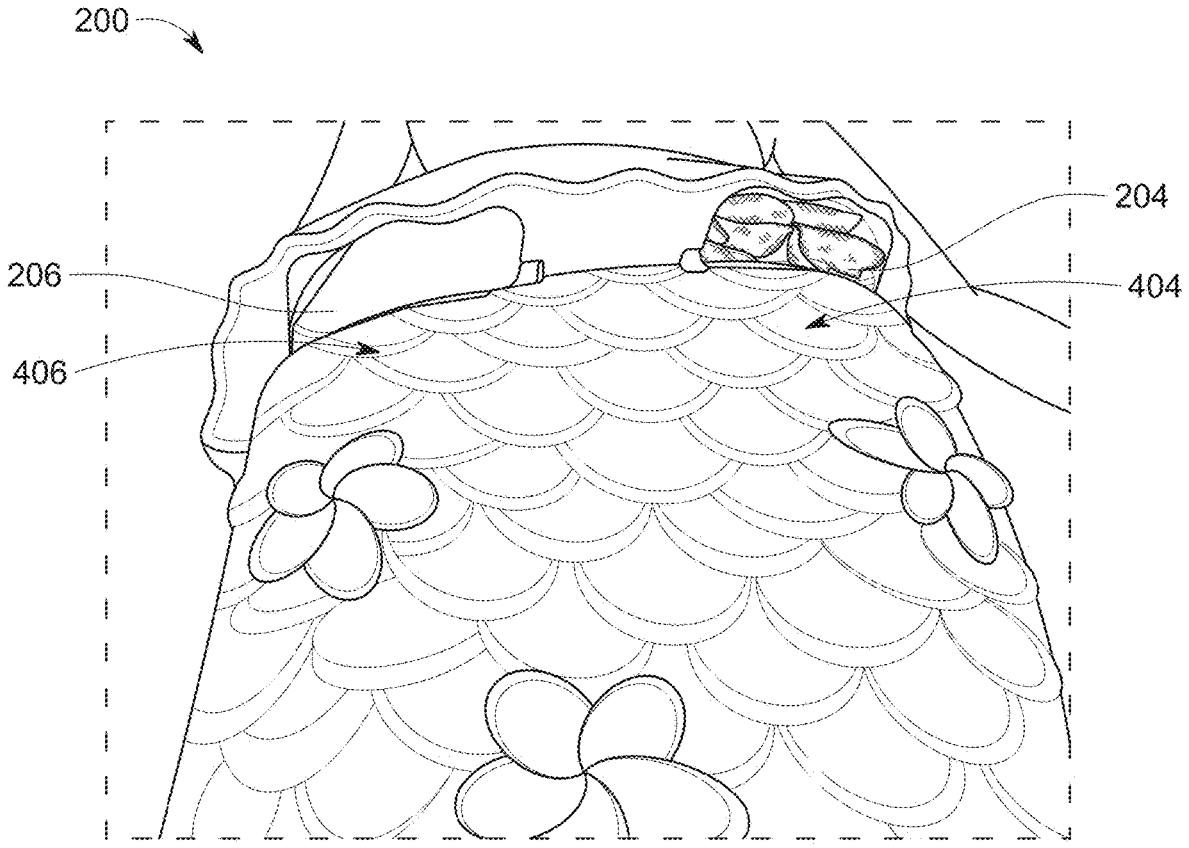

FIGS. 2A-2C illustrate an example embodiment of a toy figurine 200 with extendable surprise elements. With reference first to FIG. 2A, a toy figurine 200 is depicted in a first toggleable state. In this state, the surprise elements are retracted into the body of the toy figurine 200, or at least obscured from view by a user viewing or playing with the toy figurine 200, e.g., by styling features 201 of the toy figurine. While the toy figurine 200 that is depicted and described in FIGS. 2A-2C is a mermaid figurine, it should be appreciated that the toy figurine 200 may take other forms, including realistic entities, other mythological entities, and the like. The toy figurine 200 may also be any gender, and various embodiments may include different poses, skin colors, eye colors, hairstyles, and the like. In some embodiments, the toy is not a humanoid figurine, but may instead be an animal, fanciful creature, etc.

With reference now to FIG. 2B, the toy figurine 200 is depicted in a second togglable state. In the second togglable state, surprise elements 202, 204, 206, and 208 are visible on the toy figurine 200. In the depicted embodiment, the surprise elements 202, 204, 206, 208 are flowers made of a soft fabric material. The number of surprise elements and/or the appearance of the surprise elements (such as the shape and/or color) may differ in various embodiments. For example, one or more of the surprise elements may be in the shape of a butterfly, star, or other design. Furthermore, the surprise elements may be made of or include other flexible materials such as cloth, plastic, silicone, shape-memory polymer, elastic material, and the like.

The surprise elements 202, 204, 206, 208 may be extended from the body of the toy figurine 200 using a trigger located on the back of the toy figurine 200 or elsewhere. The trigger is used to operate a linear actuator mechanism that is provided inside of the toy figurine 200 to cause the surprise elements 202, 204, 206, 208 to extend simultaneously when actuated. The surprise elements 202, 204, 206, 208 may further be attached to soft internal linkages or flexible elements (e.g., strings, ribbons) that are used to unfold and/or bias the surprise elements 202, 204, 206, 208 when the surprise elements 202, 204, 206, 208 are extended. In the depicted embodiment, the surprise elements 202, 204, 206, 208 are configured to turn and face the same general direction away from the body of the toy figurine. More specifically, the surprise elements 202, 204, 206, 208 all unfold and open toward a user viewing the toy figurine 200 from the perspective shown in FIG. 2B. It should be appreciated that the surprise elements 202, 204, 206, 208 may be positioned in any location of the toy figurine 200, and can extend outwardly from the front, back, and/or sides of the toy figurine 200.

In some embodiments, the surprise elements 202, 204, 206, 208 may face in a direction at an angle (e.g., perpendicular) from a direction in which the linear actuator moves. For example, the toy figurine 200 is a humanoid and the surprise elements 202, 204, 206, 208 face in a direction along a sagittal plane (i.e., outwardly from the front and/or rear of the body). In other embodiments, the surprise elements may face in a direction at an offset angle (instead of being perpendicular). The angle may be determined by the string-like or flexible elements (e.g. strings, ribbons) connected to each surprise element, by how each surprise element is biased to open, and/or by an angle of the openings through which each surprise element extends.

When the toy figurine 200 switches from the second toggleable state (as shown in FIG. 2B) back to the first toggleable state (as shown in FIG. 2A), the surprise elements 202, 204, 206, 208 may retract through the openings for storage inside of the toy figurine 200 such that the surprise elements 202, 204, 206, 208 are substantially no longer visible. FIG. 2C shows two of the openings 404 and 406 on the toy figurine 200 with the surprise elements 204 and 206 stored inside. The openings may be positioned to face upwards (i.e., towards the head of the toy figurine 200) or, in this instance, face downwards (i.e., towards the tail of the toy figurine 200) so that the openings are not readily visible from the perspectives shown in FIGS. 2A and 2B. The openings are further connected to internal cavities in which the surprise elements 202, 204, 206, 208 are stored when retracted. These cavities may be large enough in volume such that the surprise elements are stored in a relaxed state (e.g., without applying more than a threshold amount of force/pressure to the surprise elements, which may each comprise of a bendable or foldable material).

The openings through which the surprise elements 202, 204, 206, 208 extend/retract may be substantially wide in at least one axis to reduce the amount of friction experienced by the surprise elements 202, 204, 206, 208 during extension/retraction. This design prevents the surprise elements 202, 204, 206, 208 from being distorted to the extent that the surprise elements 202, 204, 206, 208 do not open, while also reducing the amount of force required to extend/retract the surprise elements 202, 204, 206, 208. Each opening may also be sized to be smaller than one or more of the dimensions (e.g., height, width) of the internal cavity associated with it, but still allow the surprise element to freely move through the opening.

Figure 2D:
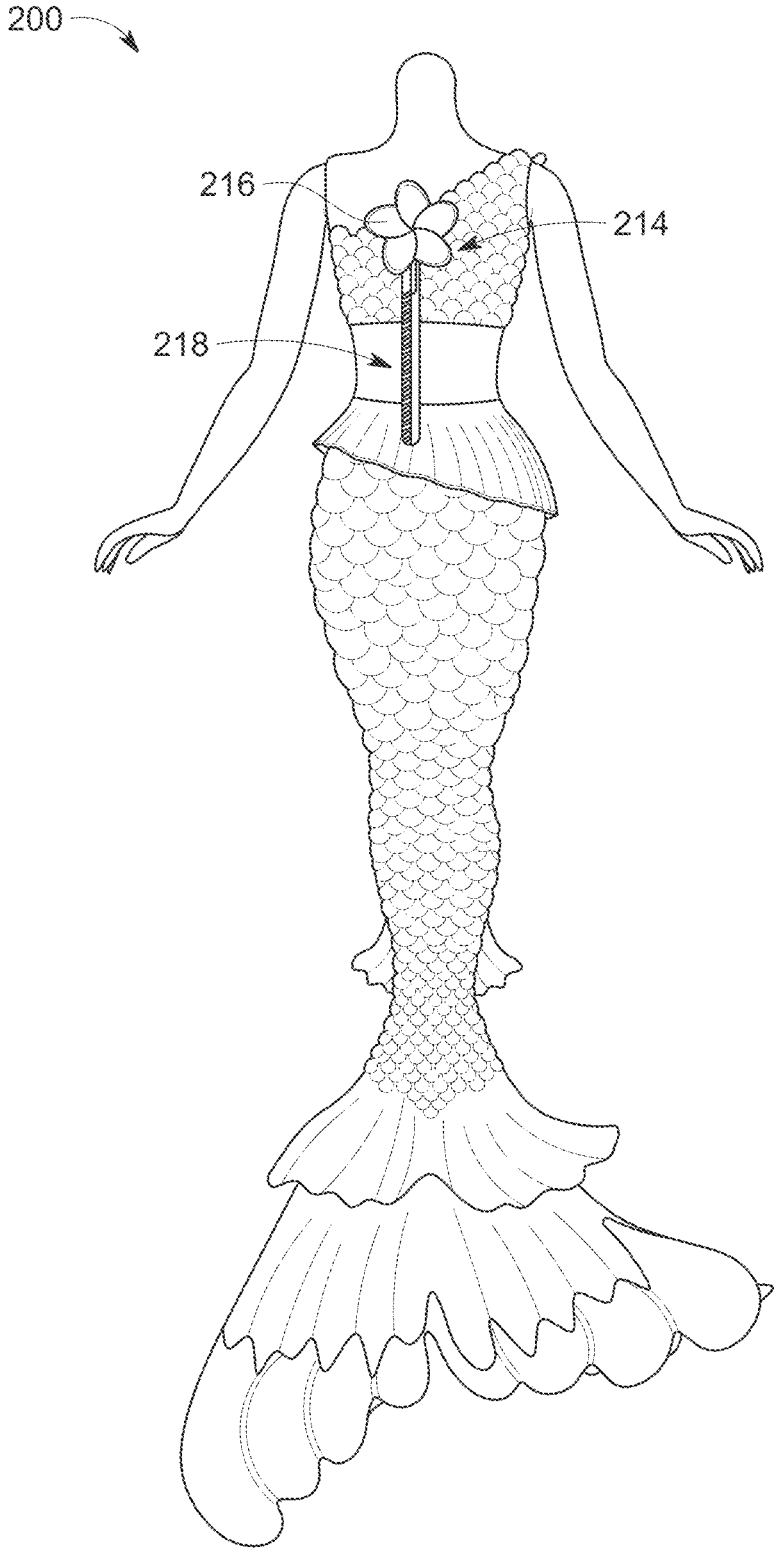

FIG. 2D illustrates a rear view of the toy figurine 200 with the head removed to illustrate the position of a trigger 214 in accordance with an example embodiment. Trigger 214 is used to operate the linear actuator housed inside the body of the toy figurine 200 and cause the toy figurine 200 to switch between the first toggleable state (see FIG. 2A) and the second toggleable state (see FIG. 2B). The trigger 214 includes a trigger knob 216, which provides a surface with which a user can engage the trigger 214. In the depicted embodiment, the trigger knob 216 is a flower, which matches other stylized elements of the toy (e.g., surprise elements 202, 204, 206, 208). In other embodiments, the trigger knob may be a different size, shape, etc., or may even be omitted. The back of the toy figurine 200 includes a slot 218 along which the trigger 214 moves to operate the linear actuator that is inside of the toy figurine 200 and cause the surprise elements 202, 204, 206, 208 to extend and/or retract.

Figure 3A:
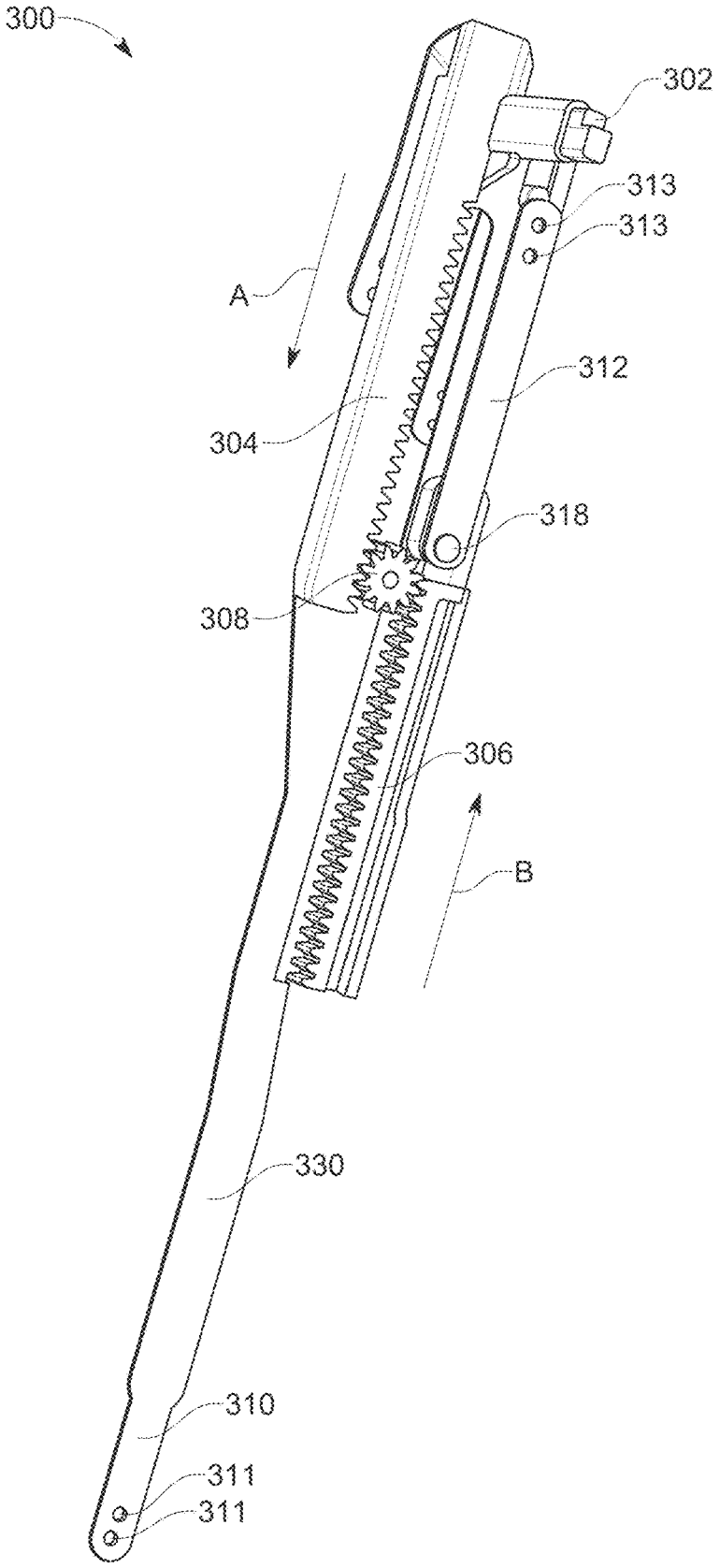
FIGS. 3A and 3B illustrate a back perspective view (FIG. 3A) and a front perspective view (FIG. 3B) of a linear actuator in accordance with an example embodiment.
Figure 3B:
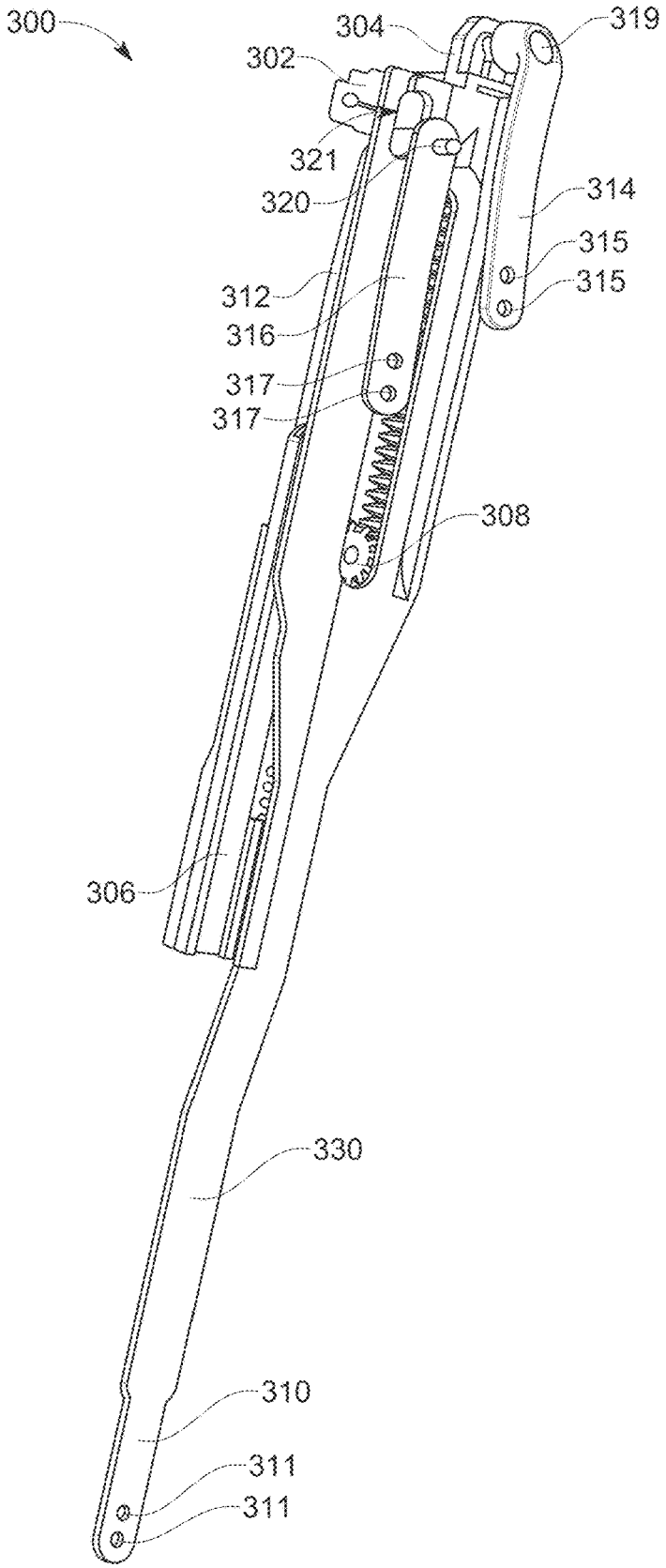

FIGS. 3A and 3B illustrate an example embodiment of a linear actuator 300 that may be housed inside the body of the toy figurine 200. With reference first to FIG. 3A, the linear actuator 300 is a double rack and pinion linear actuator comprising a first rack 304, a second rack 306, and a gear 308. A trigger 302 may extend from, or be attached to, one of the racks (e.g., rack 304, as shown). The trigger 302 enables a user to operate the linear actuator 300, causing rack 304 to move downwardly when the trigger 302 is moved downwardly (as depicted with an arrow labeled "A"), which further causes the gear 308 to rotate. Gear 308 is fixed and is provided so that rack 306 moves upwardly (as depicted with an arrow labeled "B") while rack 304 moves downwardly. In other embodiments, rack 306 may instead be fixed so that the teeth guide the gear 308 in the downward direction. A body portion 330 is included that is joined to, or extends from, the rack 304. The body portion 330 likewise moves in the same direction as the rack 304 when the trigger 302 is moved.

A connector element 312 attaches to or extends from the rack 306. Thus, when the trigger 302 is moved down (as indicated by arrow labeled "A") to cause the rack 306 to move up (as indicated by arrow labeled "B"), the connector element 312 also moves up accordingly. The connector element may include one or more holes for attaching one or more surprise elements. In this instance, the connector element 312 includes holes 313 to provide a point of attachment for the surprise element 202 (see FIG. 2B). Part of the base of the body portion 330 also forms a connector element 310 with holes 311 to provide a point of attachment for surprise element 208.

With reference now to FIG. 3B, the linear actuator 300 is shown from a front view (e.g., corresponding to a front of the toy figurine). As depicted, the linear actuator 300 includes the racks 304 and 306, the gear 308, the body portion 330, and the trigger 302. The linear actuator 300 further includes the connector elements 314 and 316, which are attached to, or extend from, the body portion 330. Connector element 314 includes holes 315, and connector element 316 includes holes 317. The holes 315 and 317 likewise provide attachment points for the surprise elements 204 and 206, respectively. Each connector element may be semi-rigid and flexible such that the connector element can bend and follow a guide that may not be perfectly linear (e.g. slightly curved or angled). Additionally, the connector elements 312, 314, 316 are connected to the linear actuator 300 via respective pivot pegs 318, 319, 320, which allow the connector elements to further move and pivot as they extend from and retract into the toy figurine.

Pivot peg 320 is further engaged with an elongated hole 321 on the body portion 330. When a user operates the linear actuator 300, the elongated hole 321 allows the body portion 330 and the connector elements 310, 314 to first move a certain distance before connector element 316 also begins to move. This results in the surprise elements all extending from the toy figurine and appearing at the same time even though the connector element 316 is positioned lower than the connector element 314 on the linear actuator 300. Thus, the timing of when the surprise elements extend and/or retract from the body of the toy figurine (e.g., simultaneously, different time points) may be adjusted through various methods, such as the positioning and length of the connector elements, as well as the use of elongated holes similar to the elongated hole 321.

Figure 4:
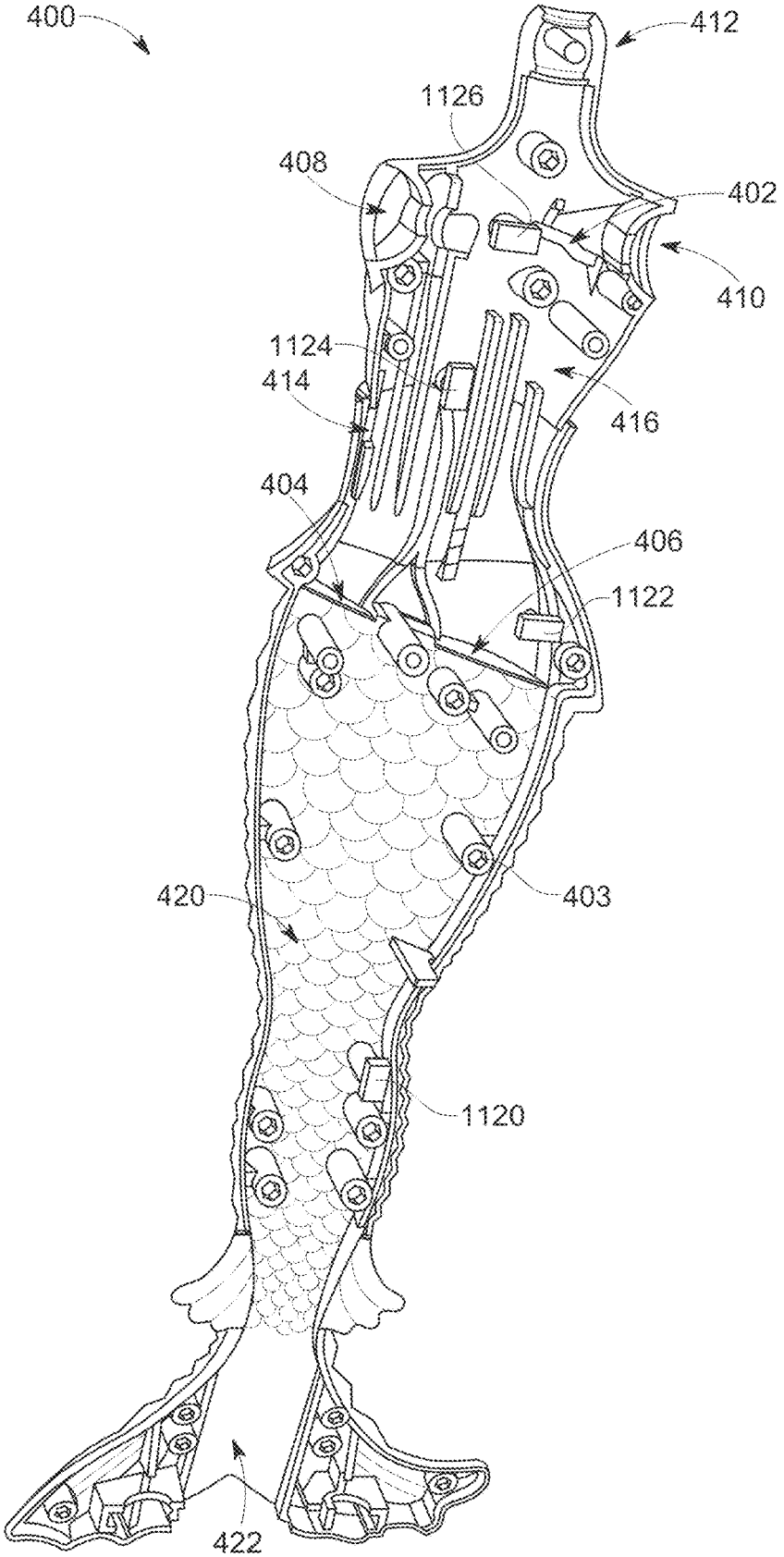
FIG. 4 illustrates a rear perspective view of a front torso element in accordance with an example embodiment.

FIG. 4 illustrates a rear view of an example embodiment of a front torso element 400 that may form the front portion of the toy figurine 200. The front torso element 400 covers or encloses various components of the toy figurine 200, such as the linear actuator 300. The front torso element 400 includes openings 402, 404, 406, through which the surprise elements 202, 204, 206 may extend when the linear actuator 300 is actuated. Also depicted are sockets 408 and 410 that can engage with other elements (e.g., arms), as well as a head connector 412. The front torso element 400 includes a front tail section 420 that is stylized as a mermaid tail, including a fin, scales, etc. An opening 422 is provided at the base of the front tail section 420 through which the connector element 310 may extend and/or retract, enabling the surprise element 208 to extend and/or retract from the base of the tail. The front torso element 400 further includes a plurality of holes and pegs 403 for snapping together with one or more other elements to form an enclosure. Also depicted are ridges 414 and 416, which help guide the connector elements 314 and 316 towards the openings 404 and 406, respectively.

Figure 5:
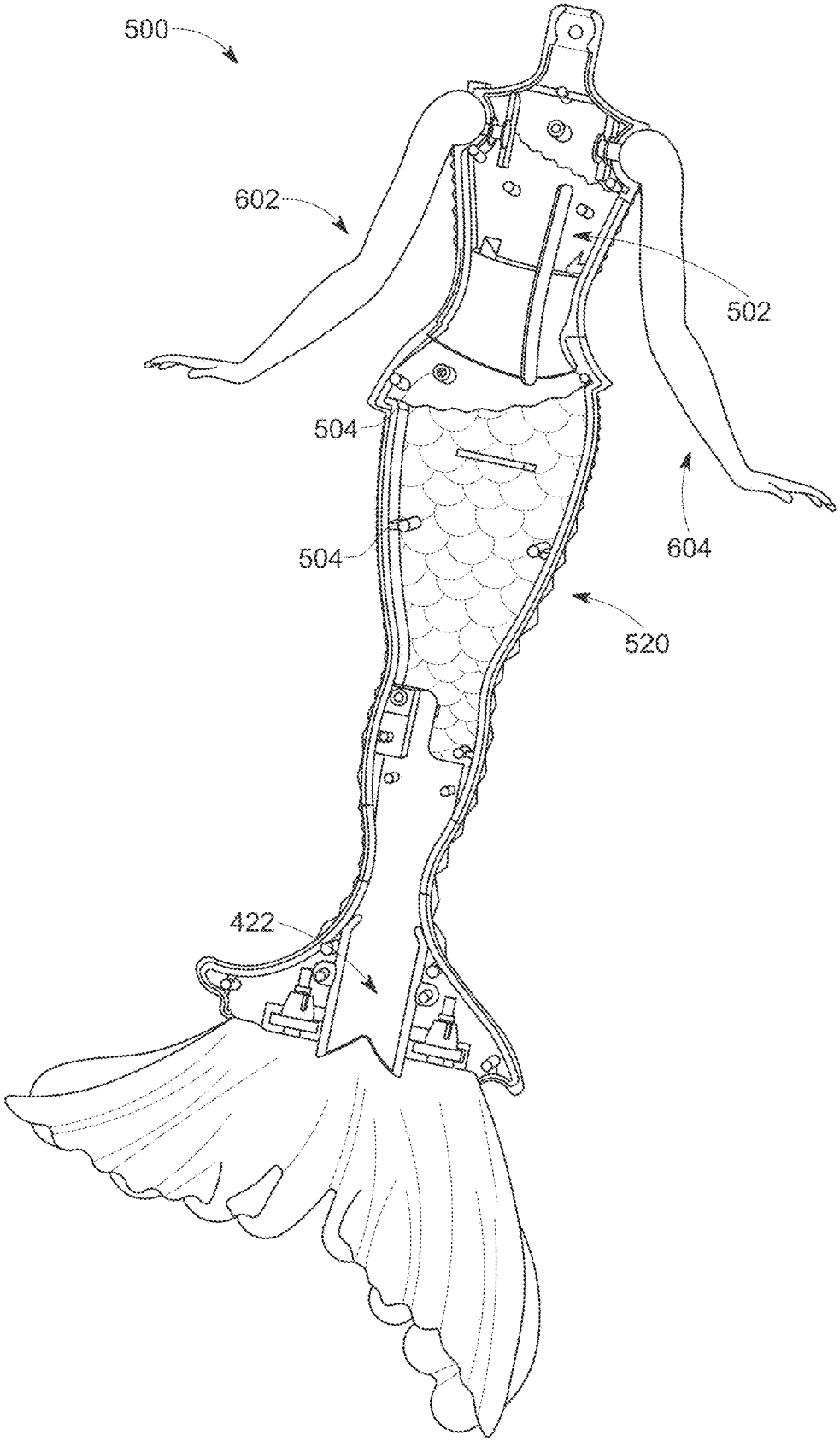
FIG. 5 illustrates a front perspective view of a rear torso element in accordance with an example embodiment.

FIG. 5 illustrates a front view of an example embodiment of a rear torso element 500 may form the back portion of the toy figurine 200. The rear torso element 500 includes a slot 502 that provides an opening through which the trigger 302 of the linear actuator 300 can extend and move along a substantially vertical direction. By sliding the trigger 302 along the slot 502, a user can operate the linear actuator 300 to cause the surprise elements 202, 204, 206, 208 to extend and/or retract from the body of the toy figurine 200. The rear torso element 500 includes a rear tail section 520 that forms the other half of the opening 422 through which the connector element 310 may extend and/or retract. The rear torso element 500 further includes a plurality of pegs and/or holes 504 that enable the rear torso element 500 to connect with other components, such as the front torso element 400.

Figure 6A:
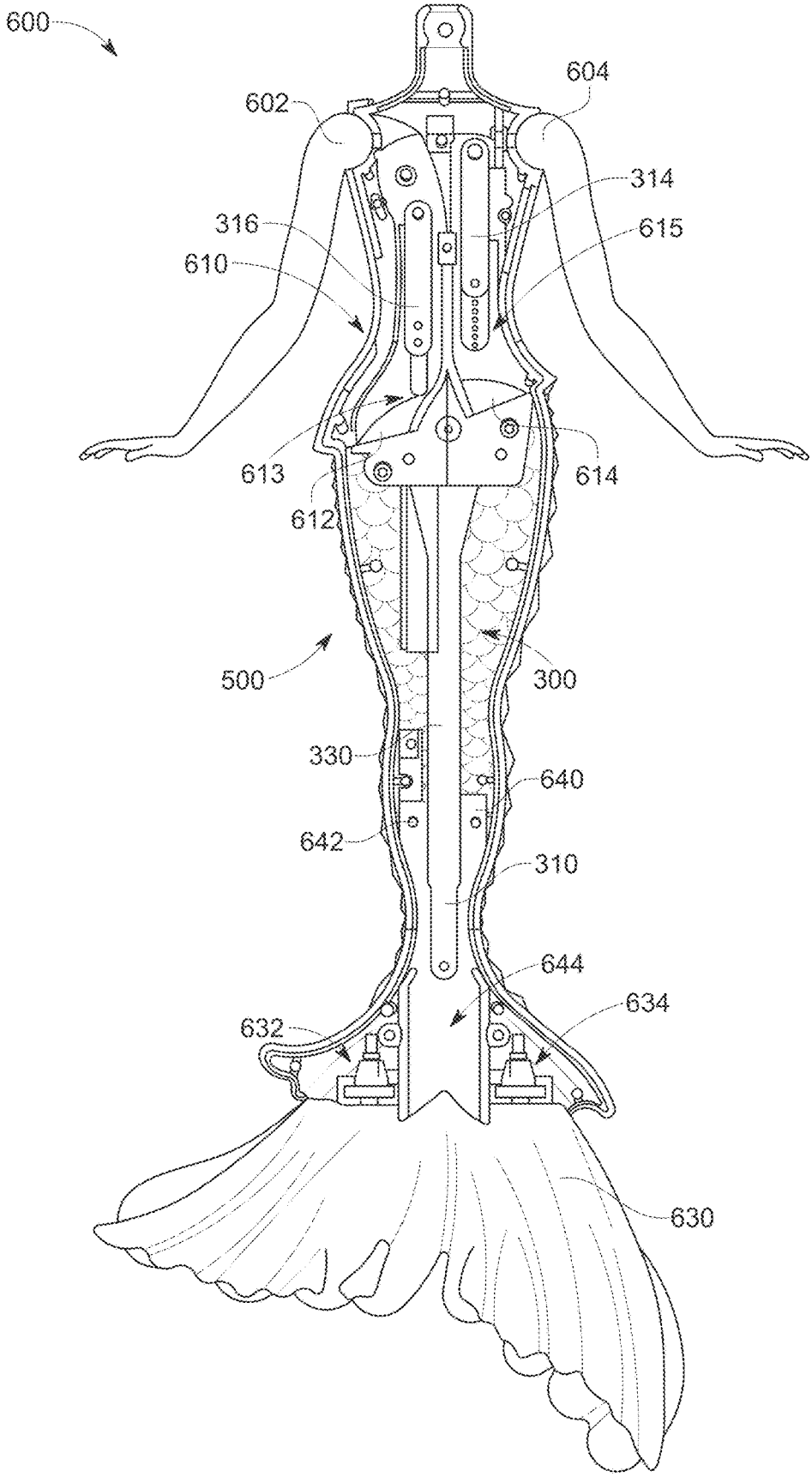
FIGS. 6A and 6B illustrate a front view (FIG. 6A) and a perspective view (FIG. 6B) of an assembly in accordance with an example embodiment.
Figure 6B:
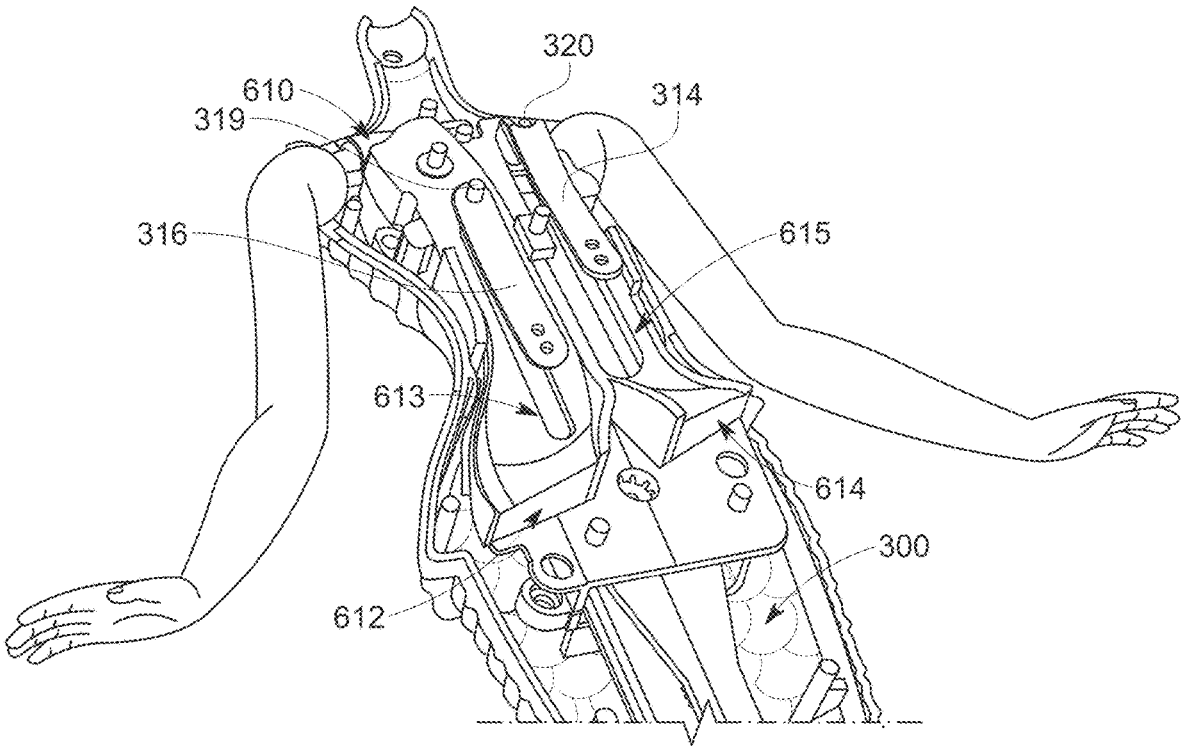

FIGS. 6A and 6B illustrate an example embodiment of an assembly 600 where the front torso element 400 of the toy figurine 200 is removed. FIG. 6A depicts a front view of the assembly 600, which shows the rear torso element 500, the linear actuator 300 positioned over the rear torso element 500, and a front inner cover 610 on top of the linear actuator 300. The front inner cover 610 includes two ramps 612 and 614. The ramps 612, 614 have sloped surfaces that direct the connector elements 314, 316 and the surprise elements 204, 206 attached to connector elements 314, 316 towards the openings 404, 406 in the front torso element 400 (see also FIGS. 2B and 4). Ramp 612 includes a slot 613 and ramp 614 includes a slot 615 that allow the pivot pegs 319, 320 to move along the ramps 612, 614 when the connector elements 314, 316 extend and retract.

The assembly 600 also includes arms 602 and 604 that are rotably connected to the rear torso element 500 and a tail fin 630 that is attached via tail attachment mechanisms 632 and 634. A tail cover 640, which houses the connector element 310, includes a plurality of pegs 642 and a ramp 644. The pegs 642 provide attachment points for other components such as the front tail section 420. The ramp 644 provides a surface that directs the connector element 310 and surprise element 208 towards the opening 422 at the base of the tail.

FIG. 6B depicts a perspective view of the front inner cover 610, including the ramps 612, 614 and slots 613, 615. As shown, the ramps 612, 614 gradually slope and curve in a manner that causes the connector elements 314, 316 to slightly bend and turn as they move towards openings 404, 406. The slots 613, 615 are engaged with the pivot pegs 319, 320 that are connected with the connector elements 314, 316 and allow those elements to slide along the front inner cover 610 when the linear actuator 300 is actuated.

Figure 7A:
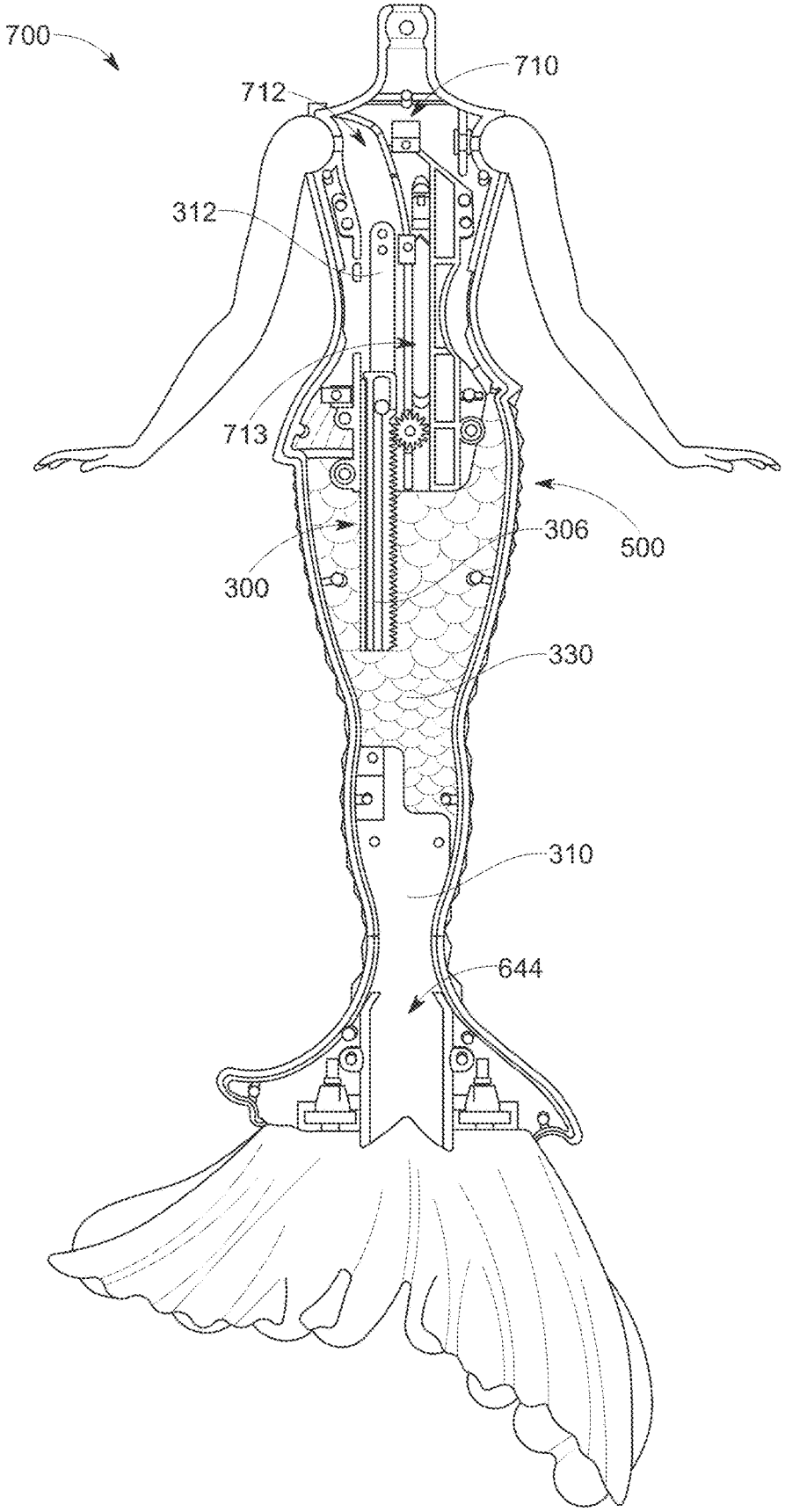
FIGS. 7A and 7B illustrate a front view (FIG. 7A) and a perspective view (FIG. 7B) of an assembly in accordance with an example embodiment.
Figure 7B:
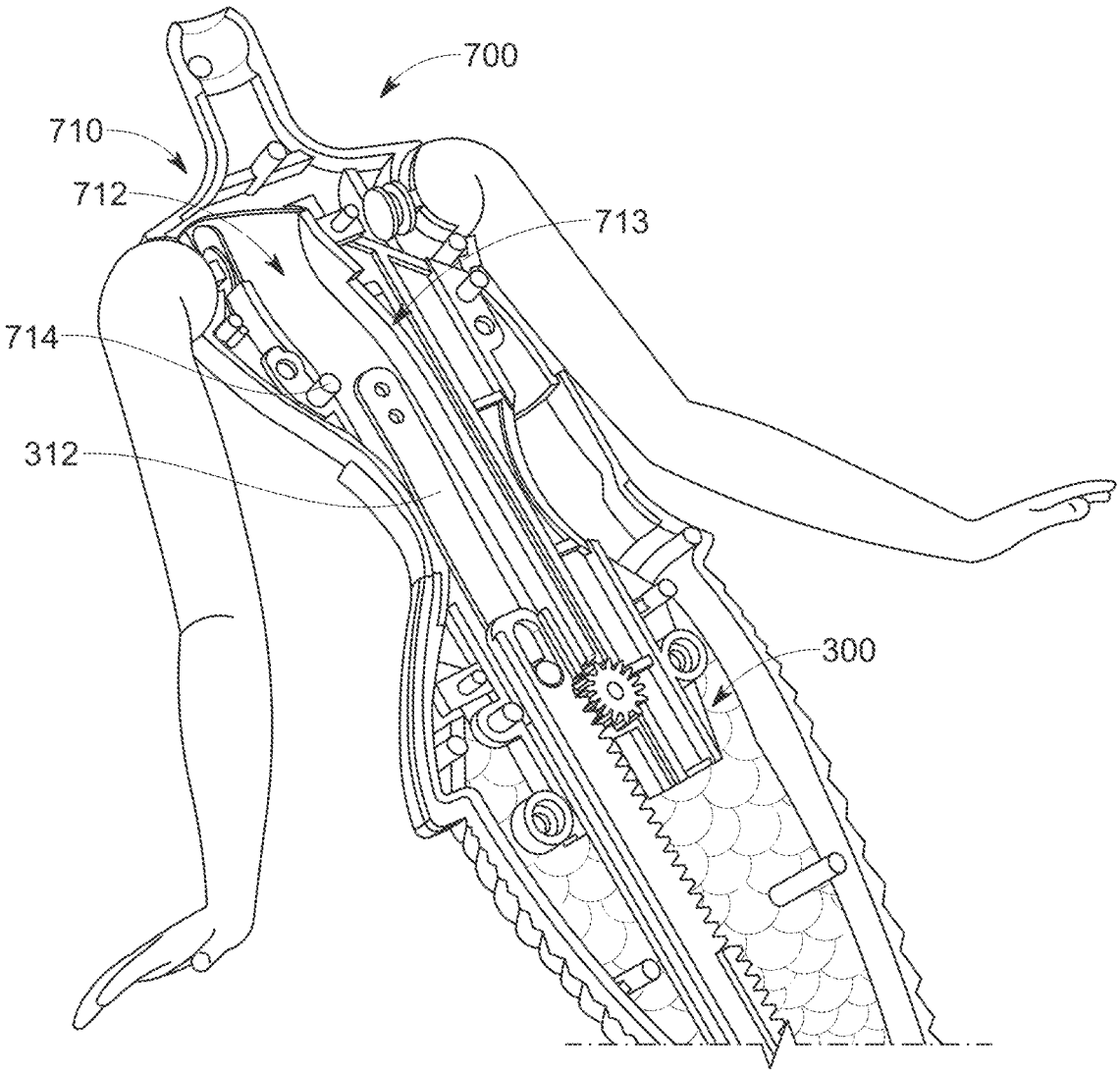

FIGS. 7A and 7B illustrate an example embodiment of an assembly 700 where the front torso element 400, front inner cover 610, and body portion 330 of the toy figurine 200 are removed. FIG. 7A depicts a front view of the assembly 700, which shows a rear inner cover 710 positioned between the second rack 306 of the actuator 300 and the rear torso element 500. The rear inner cover 710 includes a ramp 712 that provides a substantially similar function as ramps 612, 614 of the front inner cover 610. In other words, the ramp 712 guides the connector element 312 as the rack 306 of the actuator 300 moves. The rear inner cover 710 also includes a slot 713 that provides an opening through which the trigger 302 of the linear actuator 300 (see FIG. 3A) can extend and be guided along when operating the linear actuator 300. FIG. 7B provides a view in perspective of the rear inner cover 710 and the ramp 712. A plurality of pegs 714 allow the rear inner cover 710 to couple with the front inner cover 610.

Referring back to FIGS. 6 and 7, when the linear actuator 300 is actuated, the connector elements 310, 312, 314, 316 and the surprise elements 202, 204, 206, 208 attached to each connector element all move along their respective ramps. More specifically, the connector element 314 extends downwardly along the ramp 614, the connector element 316 extends downwardly along the ramp 612, and the connector element 310 extends downwardly along the ramp 644. Additionally, connector element 312 extends upwardly along ramp 712. Thus, the assembly 600 provides a mechanism that uses a single movement by a user to either extend or retract multiple surprise elements, which simplifies play and engagement. As there is a small number of parts involved in the assembly 600, the manufacturing process is simplified while also reducing the number of points of any potential failure, extending the lifespan of a toy. The assembly 600 further provides a mechanism where the movement of the trigger causes the connector elements to simultaneously move in two different directions (i.e., the connector elements 310, 314, 316 move downwards while the connector element 312 moves upwards). In other embodiments, the connector elements may all extend in the same direction or any number of different directions.

Figure 8:
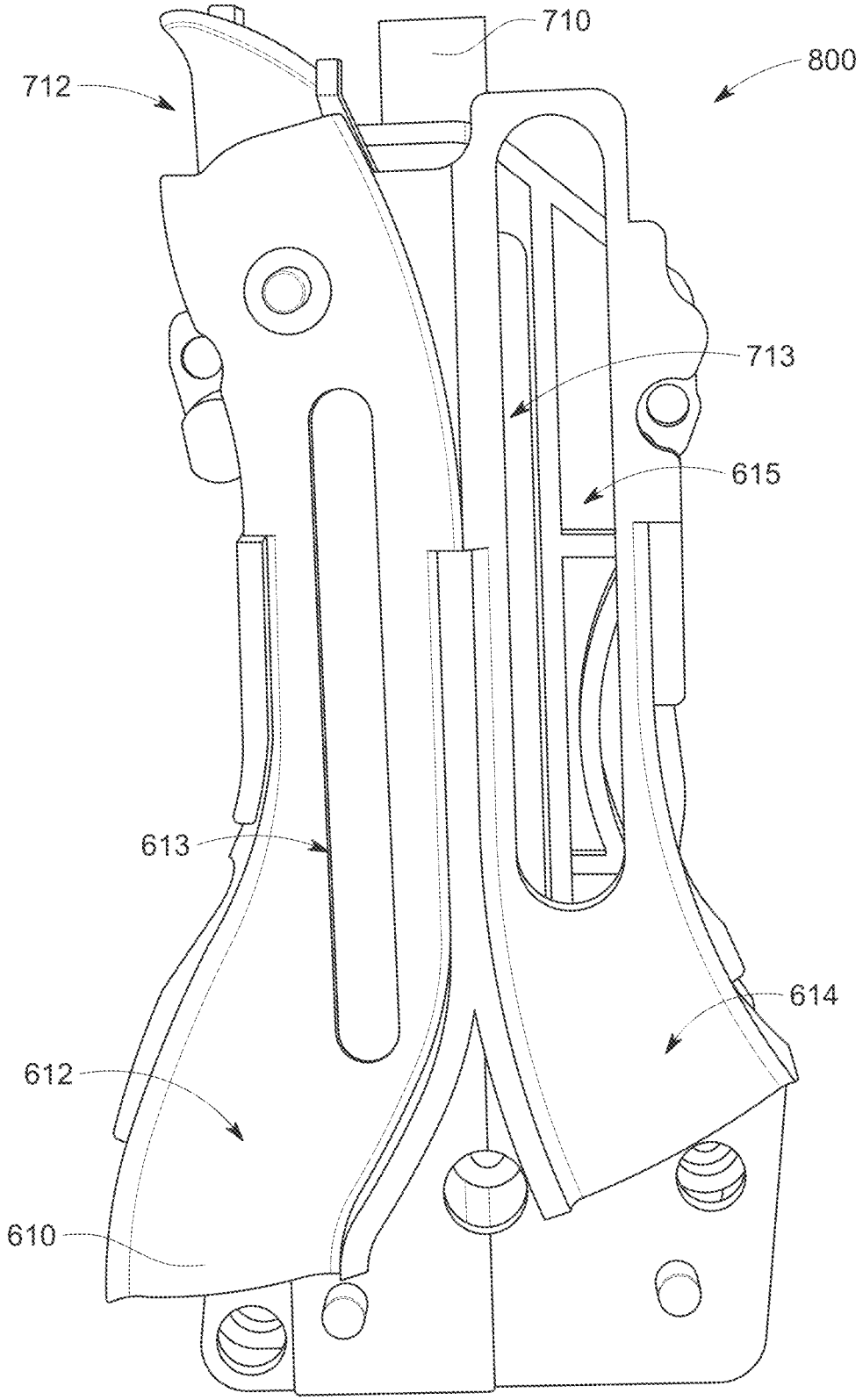
FIG. 8 illustrates a front view of an assembly in accordance with an example embodiment.

FIG. 8 illustrates an example embodiment of an assembly 800 comprising of the front inner cover 610 and the rear inner cover 710. In particular, the rear of the front inner cover 610 is joined to the front of the rear inner cover 710. The assembly 800 can be attached to other elements, such as the front torso element 400 and/or rear torso element 500, as well as the linear actuator 300.

Figure 9A:
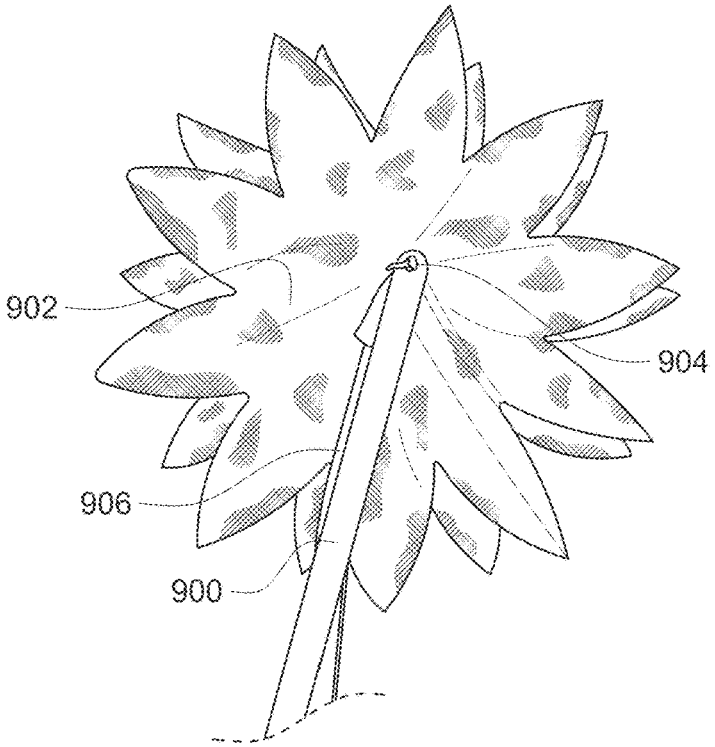
FIGS. 9A and 9B illustrate a back view (FIG. 9A) and a perspective view (FIG. 9B) of a surprise element in accordance with an example embodiment.
Figure 9B:
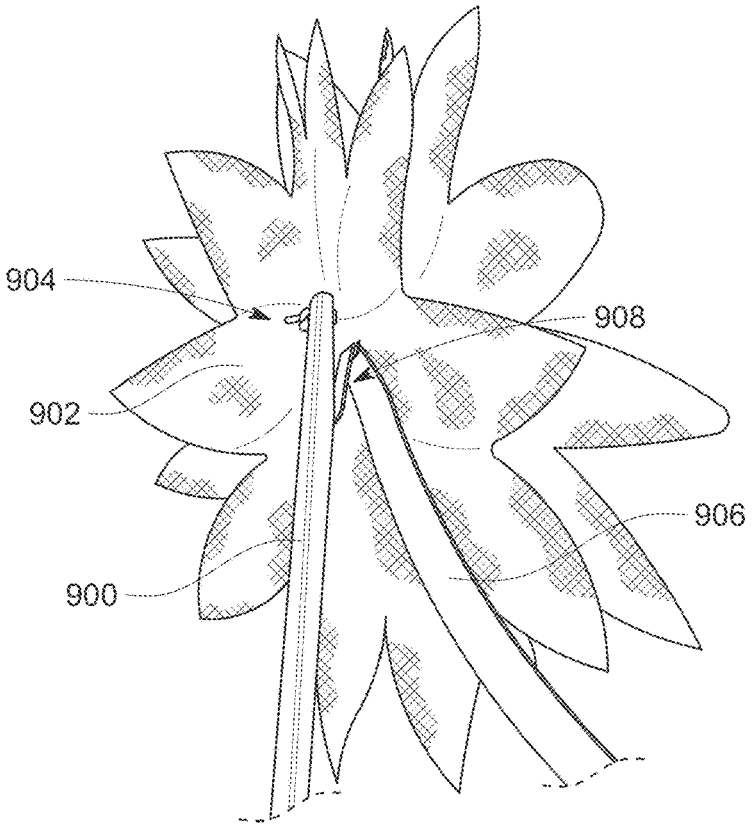

FIGS. 9A and 9B illustrate an example embodiment of a connector element 900 with an attached surprise element 902. The surprise element 902 is attached to the connector element 900 at a connection point 904. A string-like element 906 is further connected to the surprise element 902 at a connection point 908. As will be described in further detail below, the connection point 908 is offset from the connection point 904 to allow the surprise element 902 to turn and face a specific direction as the connector element 900 extends.

Figure 10C:
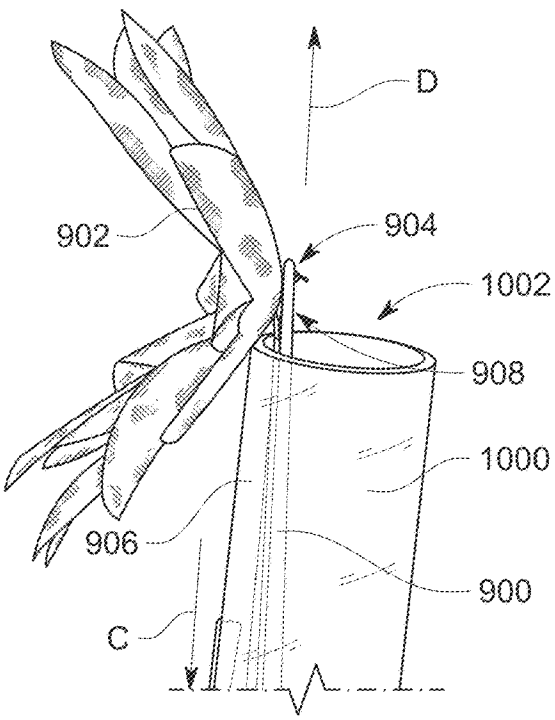
FIGS. 10A-10C illustrate the extension of a connector element and the opening of a surprise element in accordance with an example embodiment.
Figure 10B:
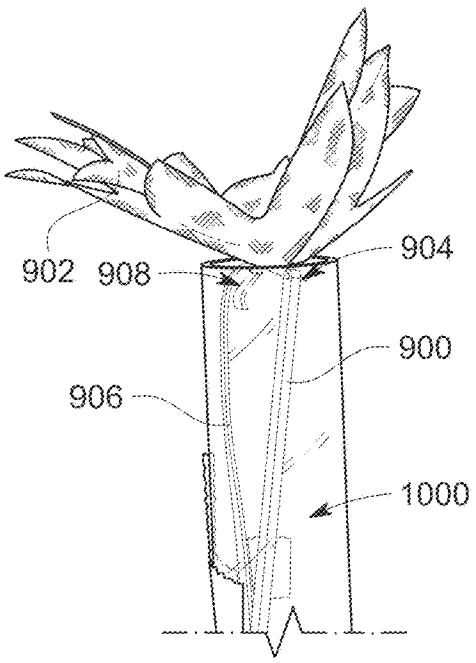
Figure 10A:
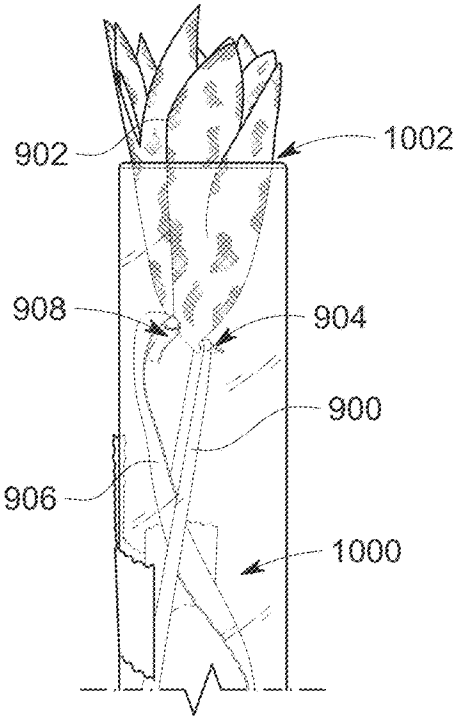

FIGS. 10A-10C illustrate the extension of the connector element 900 and the opening of the surprise element 902 in accordance with an example embodiment. FIG. 10A depicts the connector element 900 with the attached surprise element 902 partially retracted within a cavity 1000. The size of an opening 1002 of the cavity 1000 causes the surprise element 902 to be folded or closed while it is at least partially housed within cavity 1000. The cavity 1000 is further sized to accommodate the surprise element 902 without applying too much pressure and prevent the surprise element 902 from being permanently deformed. The string-like element 906 that is connected to the surprise element 902 is also housed within cavity 1000 and is slack while the connector element 900 is at least partially retracted.

FIG. 10B depicts the connector element 900 being extended to the point that the surprise element 902 is no longer within the cavity 1000. In this embodiment, the resiliency of the fabric used to form the surprise element 902 allows the surprise element 902 to automatically unfold or open and return to its original flower shape as it is no longer constrained by the cavity 1000. In other embodiments, the surprise element may be made of other materials and/or include elements that help the surprise element retain its resiliency, such as a plastic or metallic backing material. As depicted, the connector element 900 is not yet fully extended and thus there is still slack to the string-like element 906.

FIG. 10C depicts the connector element 900 fully extended. The connector element 900 partially extends outside of the cavity 1000 and the string-like element 906 is now fully lengthened and taut. The string-like element 906 pulls the surprise element 902 downwards in a direction "C" as the connector element 900 moves in an opposite upwards in a direction "D". Thus, the surprise element 902 unfolds and faces a direction substantially perpendicular to the connector element 900 and the direction that the connector element 900 moves while extending from the cavity 1000 (i.e., direction "D"). In other embodiments, the surprise element may face a different direction or angle depending on the length of the connector element and/or the string-like element.

Figure 11:
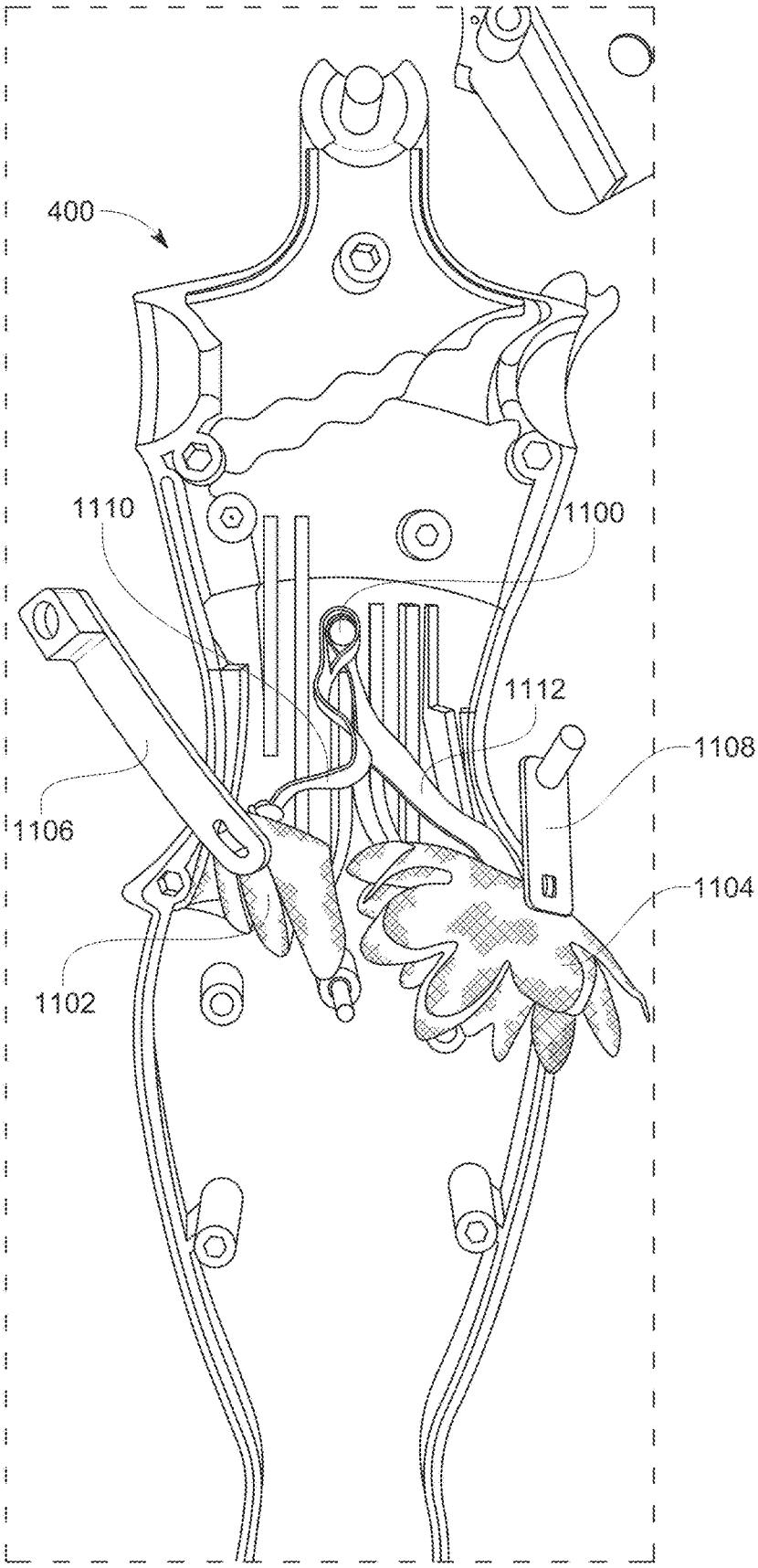
FIG. 11 illustrates a front view of string-like elements anchored to a front torso element in accordance with an example embodiment.

FIG. 11 illustrates how the string-like elements may be secured to one or more anchors 1100 inside the body of a toy figurine in accordance with an example embodiment. As depicted, two surprise elements 1102, 1104 are respectively connected to connector elements 1106, 1108 and string-like elements 1110, 1112. Both string-like elements 1110, 1112 are secured on the other end to an anchor 1100 that is formed as part of the front torso element 400. In other embodiments, one or more of the anchors may be formed as part of the rear torso element or as a separate component. The position of the anchor may depend on the location of the connecting element and/or the length of the string-like element. In some embodiments, each string-like element may be connected to a separate anchor. For instance, FIG. 4 depicts the anchors 1120, 1122, 1124, 1126 which respectively anchor the string-like elements associated with the connector elements 310, 312, 314, 316.

Figure 12A:
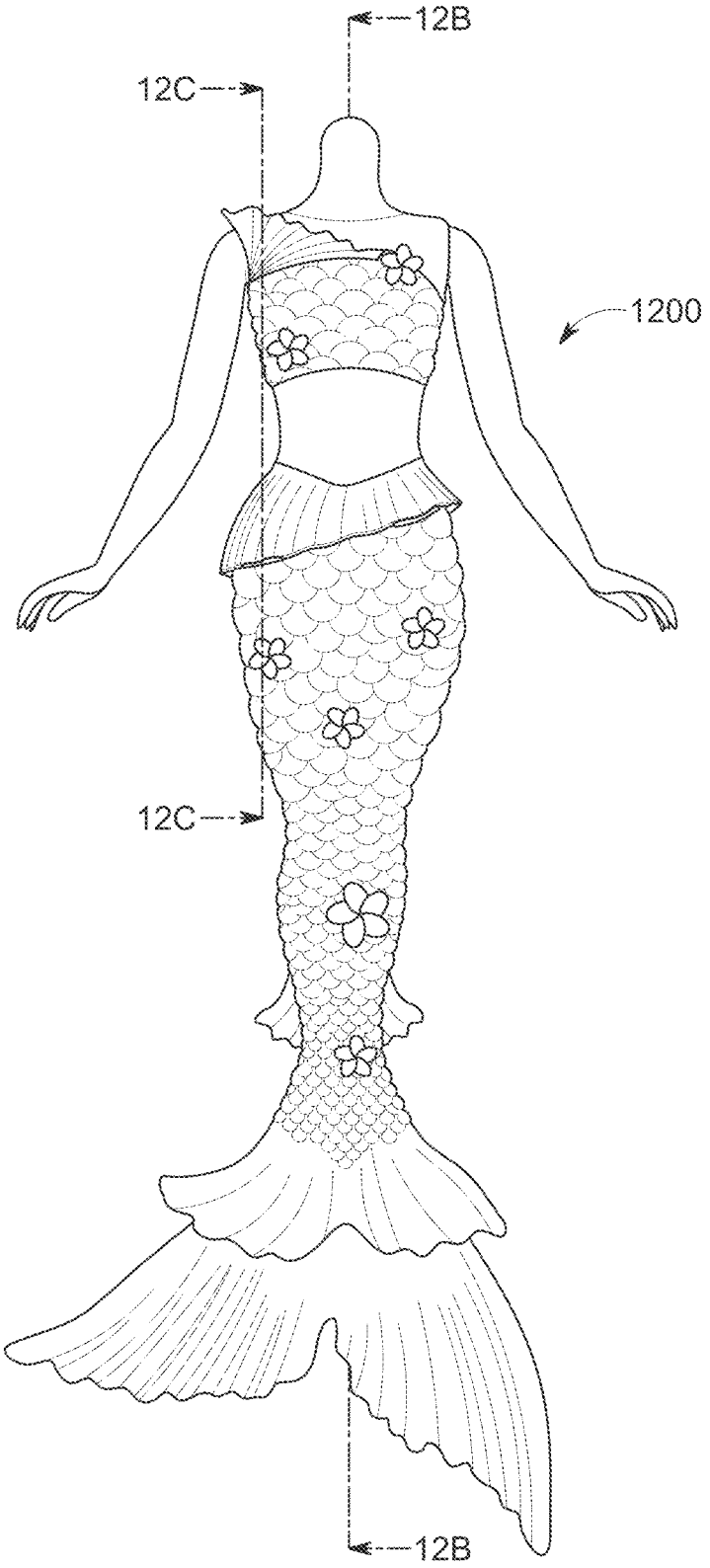
FIGS. 12A-12C illustrate cross-sectional views of an assembly in accordance with an example embodiment.
Figure 12B:
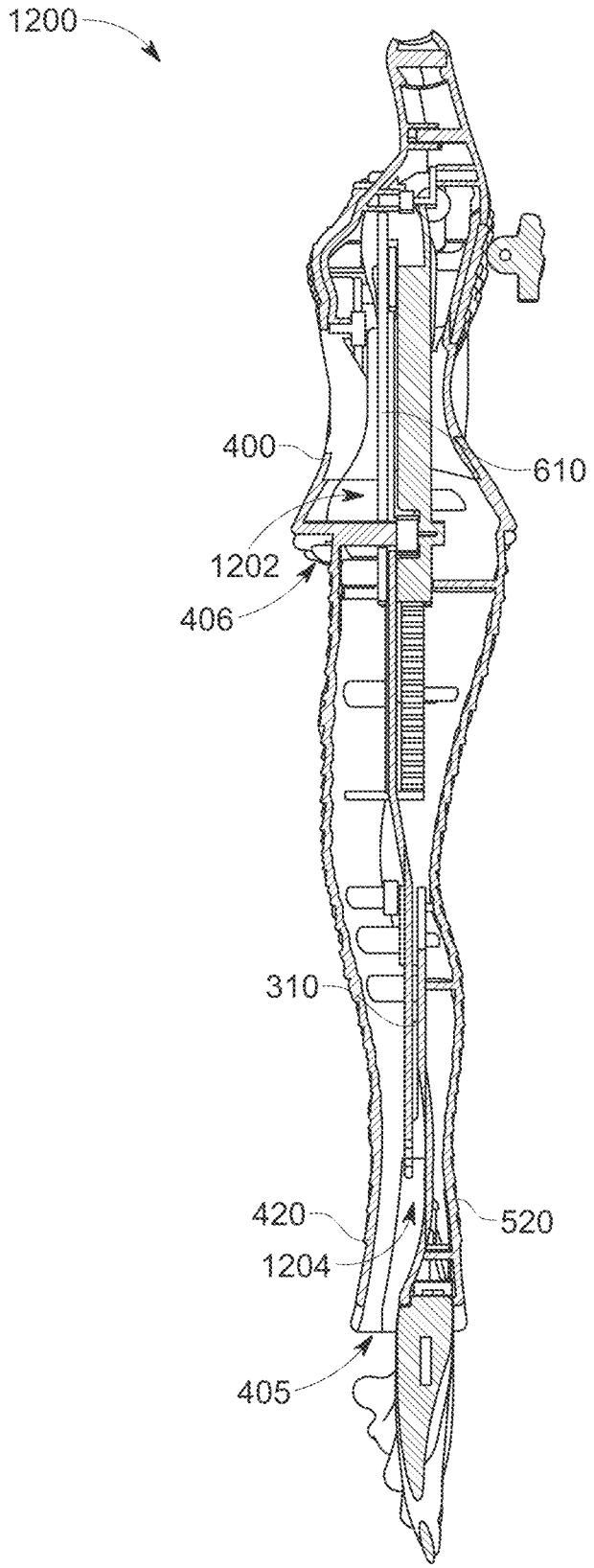
Figure 12C:
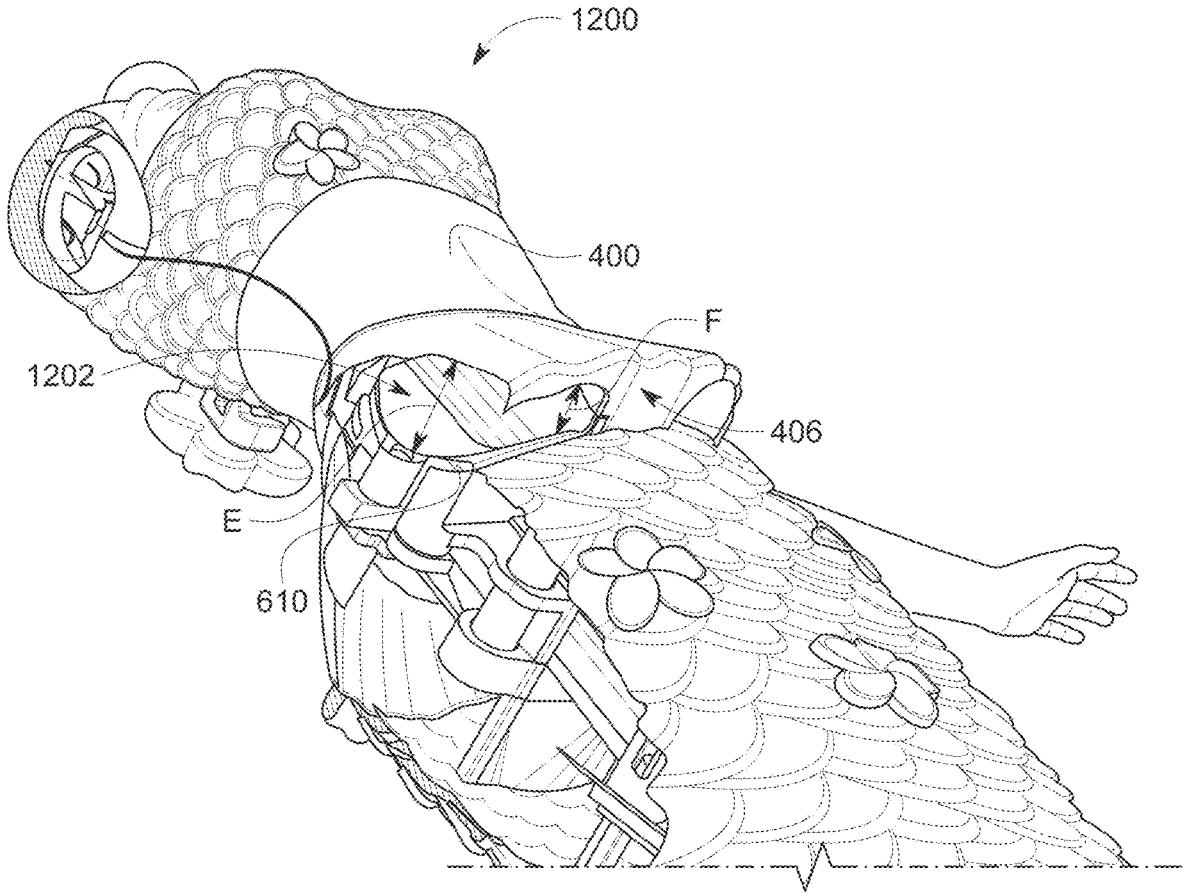

FIGS. 12A-12C illustrate cross-sectional views of an assembly 1200 in accordance with an example embodiment. Initially, FIG. 12A illustrates the planes for the cross-sectional views of FIGS. 12B and 12C.

FIG. 12B illustrates a side cross-sectional view of the assembly 1200 that depicts the openings 405, 406. Also depicted is a cavity 1202, which is formed in the space between the front torso element 400 and the front inner cover 610. The cavity 1202 may provide space for storing the surprise element 204 when the surprise element 204 is retracted. Similarly, a cavity 1204 is formed in the space between the front tail section 420 and the rear tail section 520. The cavity 1204 may provide space for storing the surprise element 208 when the surprise element 208 is retracted.

FIG. 12C illustrates a cross-sectional view of the assembly 1200 that depicts the cavity 1202 and the opening 406. The cavity 1202 may be substantially larger than the surprise element 206 to accommodate the surprise element 206 without applying too much pressure and/or offering too much resistance to the surprise element 206 during extension, retraction, or storage. To illustrate this concept, the cavity 1202 is labeled with a height dimension "E". This height dimension "E" may be a certain proportion of the maximum height of the corresponding surprise element 206 when it is in its folded or collapsed state. For example, the height dimension "E" may be approximately 50-95% of the maximum height of the folded or collapsed surprise element 206 that is storable therein, such as 60-85%, 65%-85%, etc. To be clear, the cavity 1202 is only labeled with the height dimension "E" as an example and any or all of the other cavities may be dimensioned in accordance with the same or different proportions.

Opening 406 is labeled with a height dimension "F" and may also be a certain proportion of the maximum height of the surprise element 206 in its folded or collapsed state. The height dimension "F" is sized so that the surprise element 206 is able to extend/retract through the opening 404 without being permanently distorted or deformed. The height dimension "F" of the opening 406 is also less than the height dimension "E" of the cavity 1202 so that the opening is less conspicuous to the user. The width of the opening may be the same or different from the width of the cavity.

While the toy figurine and/or toy presented herein has been illustrated and described in detail and with reference to specific embodiments thereof, it is nevertheless not intended to be limited to the details shown, since it will be apparent that various modifications and structural changes may be made therein without departing from the scope of the inventions and within the scope and range of equivalents of the claims. In addition, various features from one of the embodiments may be incorporated into another of the embodiments. That is, it is believed that the disclosure set forth above encompasses multiple distinct inventions with independent utility. While each of these inventions has been disclosed in a preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Accordingly, it is appropriate that the appended claims be construed broadly and in a manner consistent with the scope of the disclosure as set forth in the following claims.

It is also to be understood that the toy figurine and/or toy described herein, or portions thereof may be fabricated from any suitable material or combination of materials, such as plastic, foamed plastic, wood, cardboard, pressed paper, metal, supple natural or synthetic materials including, but not limited to, cotton, elastomers, polyester, plastic, rubber, derivatives thereof, and combinations thereof. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, derivatives thereof, and combinations thereof.

Additionally, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Finally, when used herein, the term "comprises" and its derivations (such as "comprising", etc.) should not be understood in an excluding sense, that is, these terms should not be interpreted as excluding the possibility that what is described and defined may include further elements, steps, etc. Similarly, where any description recites "a" or "a first" element or the equivalent thereof, such disclosure should be understood to include incorporation of one or more such elements, neither requiring nor excluding two or more such elements. Meanwhile, when used herein, the term "approximately" and terms of its family (such as "approximate", etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially".

What is claimed is:

1. A toy figurine comprising:

a body portion having a slot and one or more openings;

a linear actuator substantially inside of the body portion, wherein the linear actuator includes a trigger that extends through the slot, wherein sliding the trigger from a first position to a second position along the slot causes the linear actuator to linearly move one or more connector elements within the body portion; and one or more surprise elements attached to each of the one or more connector elements, wherein the one or more surprise elements are biased to unfold when the one or more connector elements and each of the one or more surprise elements engages with a corresponding internal ramp to direct the one or more surprise elements to extend through the one or more openings of the body portion while the trigger slides from the first position to the second position, and wherein the one or more surprise elements turn to face in a substantially perpendicular direction with respect to a direction in which the linear actuator moves when moving through the one or more openings of the body portion.

2. The toy figurine of claim 1, wherein sliding the trigger from the second position to the first position causes the one or more surprise elements to retract to a position substantially internal to the body portion.

3. The toy figurine of claim 1, further comprising one or more string-like elements inside the body portion, wherein a first end of the one or more string-like elements is connected to the body portion and a second end of the one or more string-like elements is connected to the one or more surprise elements.

4. The toy figurine of claim 1, wherein the linear actuator comprises a double rack and pinion, and wherein the one or more connector elements are attached to either a first rack or a second rack of the double rack and pinion.

5. A toy figurine comprising:

a body portion having one or more openings and styling features, the one or more openings being at least partially obscured by the styling features; and a mechanism with an actuator configured to extend externally of the body portion, wherein actuating the actuator from a first position to a second position causes surprise elements to engage with internal ramps that cause the surprise elements to move out of the one or more openings to change a styling of the body portion, and wherein the surprise elements turn to face in a substantially perpendicular direction with respect to a direction in which the actuator moves when moving through the one or more openings of the body portion.

6. The toy figurine of claim 5, wherein actuating the actuator from the second position to the first position causes the surprise elements to retract to a position substantially internal to the body portion.

7. The toy figurine of claim 5, wherein the actuator comprises a double rack and pinion.

8. The toy figurine of claim 5, further comprising:

flexible elements connecting the surprise elements to the body portion, wherein each of the flexible elements is attached to one of the surprise elements at a point that allows the flexible elements to bias the surprise elements to unfold at an angle with respect to connector elements of the mechanism that couple the surprise elements to the actuator.

9. A toy comprising:

a body portion having an opening;

a linear actuator enclosed within the body portion, the linear actuator including a connector element and a surprise element coupled to the connector element at a first point on the surprise element, wherein the linear actuator is moveable between a first position and a second position; and a flexible element inside the body portion, the flexible element connecting the surprise element to the body portion, with the flexible element being attached to the surprise element at a second point on the surprise element, the second point being different from the first point so that the flexible element biases the surprise element to unfold at an angle with respect to the connector element when the linear actuator moves to the second position;

wherein in the first position the connector element and surprise element are both retracted inside the body portion and the surprise element is in a folded state, and in the second position the connector element is extended through the opening and the surprise element is in an unfolded state outside the body portion.

10. The toy of claim 9 wherein the surprise element is perpendicular to the connector element when the linear actuator is in the second position.

11. The toy of claim 9 wherein the body portion defines a cavity connected to the opening, and at least one of a height or width of the opening is less than a maximum height or width of the cavity.

12. The toy of claim 9 wherein the body portion includes a slot and the linear actuator includes a trigger that extends through the slot, and wherein sliding the trigger along the slot causes the linear actuator to move between the first position and the second position.

13. The toy of claim 9 wherein:

the body portion comprises two or more openings, including the opening; and the linear actuator includes two or more connector elements, including the connector element, positioned to simultaneously extend through the two or more openings when the linear actuator moves to the second position.

14. The toy of claim 13 wherein:

two or more surprise elements are coupled to the two or more connector elements;

two or more flexible elements connect the two or more surprise elements to the body portion; and the two or more flexible elements cause the two or more surprise elements to simultaneously unfold when the linear actuator moves to the second position.

15. The toy of claim 14 wherein at least one of the two or more openings faces a direction different from another opening of the two or more openings.

16. The toy of claim 9, wherein the surprise element extends through the opening and turns to face in a substantially perpendicular direction with respect to a direction in which the linear actuator moves.

17. The toy of claim 16, wherein the connector element engages with an internal ramp to direct the surprise element through opening of the body portion while the linear actuator moves from the first position to the second position.

18. A toy comprising:

a body portion having two or more openings;

a linear actuator enclosed within the body portion and moveable between a first position and a second position, the linear actuator comprises a double rack and pinion where at least one of two or more connector elements is connected to a first rack of the double rack and pinion and at least one other connector element of the two or more connector elements is connected to a second rack of the double rack and pinion, and the linear actuator further comprises two or more surprise elements each being coupled to one of the two or more connector elements; and two or more flexible elements inside the body portion, the two or more flexible elements connecting the two or more surprise elements to the body portion, wherein, in the first position, the two or more connector elements and the two or more surprise elements are retracted inside the body portion and the two or more surprise elements are each in a folded state, and in the second position, the two or more connector elements extend through the two or more openings and the two or more surprise elements are each in an unfolded state outside the body portion.

19. The toy of claim 18, wherein the two or more surprise elements extend through the two or more openings and turn to face in a substantially perpendicular direction with respect to a direction in which the linear actuator moves.

20. The toy of claim 19, wherein each of the two or more connector elements engages with a corresponding internal ramp to direct the two or more surprise elements through the two or more openings of the body portion while the linear actuator moves from the first position to the second position.

* * * * *